US007623801B2

(12) United States Patent
Kin et al.

(10) Patent No.: US 7,623,801 B2
(45) Date of Patent: Nov. 24, 2009

(54) IMAGE FORMING APPARATUS AND CONTROL METHOD THEREOF

(75) Inventors: Hidenori Kin, Nagano-ken (JP); Keiichi Taguchi, Nagano-ken (JP); Hidetsugu Shimura, Nagano-ken (JP); Shinsuke Yokote, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 424 days.

(21) Appl. No.: 11/377,227

(22) Filed: Mar. 15, 2006

(65) Prior Publication Data

US 2006/0222389 A1 Oct. 5, 2006

(30) Foreign Application Priority Data

Mar. 31, 2005 (JP) ..... 2005-101220
Mar. 31, 2005 (JP) ..... 2005-101221
Mar. 31, 2005 (JP) ..... 2005-101223
Dec. 19, 2005 (JP) ..... 2005-364520

(51) Int. Cl.
*G03G 15/08* (2006.01)

(52) U.S. Cl. ..... 399/27; 399/49

(58) Field of Classification Search ..... 399/27, 399/49

See application file for complete search history.

(56) References Cited

U.S. PATENT DOCUMENTS 5,579,090 A 11/1996 Sasanuma et al.
5,812,903 A 9/1998 Yamada et al.
6,185,386 B1 2/2001 Noguchi
6,324,375 B1 11/2001 Hada et al.
6,341,203 B1 1/2002 Nakazato et al.
6,415,114 B1 7/2002 Nakazato et al.
6,427,062 B1 7/2002 Takeuchi
6,597,878 B2 7/2003 Nakazato et al.
6,775,489 B2 8/2004 Tsuruya et al.

(Continued)

FOREIGN PATENT DOCUMENTS

JP 61209470 A 9/1986

(Continued)

*Primary Examiner*—David M Gray
*Assistant Examiner*—Bryan P Ready
(74) *Attorney, Agent, or Firm*—Hogan & Hartson LLP

(57) ABSTRACT

An image forming apparatus for forming an image corresponding to an image signal on a recording material, comprising: a signal processor which generates an image-formation control signal by subjecting the image signal to a signal processing process including a screening process selectively using one of plural types of different processing screens; an image forming unit which includes an intermediate transfer medium, and which forms the image by forming a toner image on the intermediate transfer medium corresponding to the image-formation control signal and transferring and fixing the toner image to a recording material; and a detector which detects a quantity of the toner carried on the intermediate transfer medium as the toner image, wherein the signal processing process performed by the signal processor includes a tone correction process for compensating for a gamma characteristics of the apparatus based on a detection result given by the detector detecting a toner image formed as a patch image by using the processing screen and a transferring/fixing characteristics, which represents a relation between a quantity of toner constituting a toner image carried on the intermediate transfer medium and a density of an image formed on the recording material as a result of transferring and fixing the toner image to the recording material, previously determined in correspondence to the processing screen.

7 Claims, 21 Drawing Sheets

U.S. PATENT DOCUMENTS

| | | | | |
|---|---|---|---|---|
| 6,909,858 | B2 | 6/2005 | Hama et al. | |
| 6,934,481 | B2 | 8/2005 | Hama | |
| 7,013,093 | B2 | 3/2006 | Nakazato | |
| 7,149,439 | B2 | 12/2006 | Hirata et al. | |
| 7,269,362 | B2 * | 9/2007 | Hama et al. | 399/27 |
| 2002/0041770 | A1 | 4/2002 | Nakazato et al. | |
| 2004/0081476 | A1 | 4/2004 | Hama | |
| 2005/0185973 | A1 | 8/2005 | Hama et al. | |

FOREIGN PATENT DOCUMENTS

| | | | |
|---|---|---|---|
| JP | 05257353 | A | 10/1993 |
| JP | 06027776 | A | 2/1994 |
| JP | 06175452 | A | 6/1994 |
| JP | 06250480 | A | 9/1994 |
| JP | 07020669 | A | 1/1995 |
| JP | 07131649 | A | 5/1995 |
| JP | 08230234 | A | 9/1996 |
| JP | 2729976 | B2 | 3/1998 |
| JP | 10198088 | A | 7/1998 |
| JP | 10278347 | A | 10/1998 |
| JP | 10293432 | A | 11/1998 |
| JP | 10319669 | A | 12/1998 |
| JP | 11184181 | A | 7/1999 |
| JP | 11249374 | A | 9/1999 |
| JP | 11265132 | A | 9/1999 |
| JP | 3098138 | B2 | 10/2000 |
| JP | 2000-333012 | | 11/2000 |
| JP | 2001075319 | A | 3/2001 |
| JP | 2001290320 | A | 10/2001 |
| JP | 2001337507 | A | 12/2001 |
| JP | 2002040726 | A | 2/2002 |
| JP | 2002116614 | A | 4/2002 |
| JP | 2002174929 | A | 6/2002 |
| JP | 2002196636 | A | 7/2002 |
| JP | 2002218245 | A | 8/2002 |
| JP | 2002236399 | A | 8/2002 |
| JP | 2002278249 | A | 9/2002 |
| JP | 2003121356 | A | 4/2003 |
| JP | 2003189104 | A | 7/2003 |
| JP | 3473304 | B2 | 12/2003 |
| JP | 2004-354666 | | 12/2004 |

* cited by examiner

FIG. 4A : SCREEN A
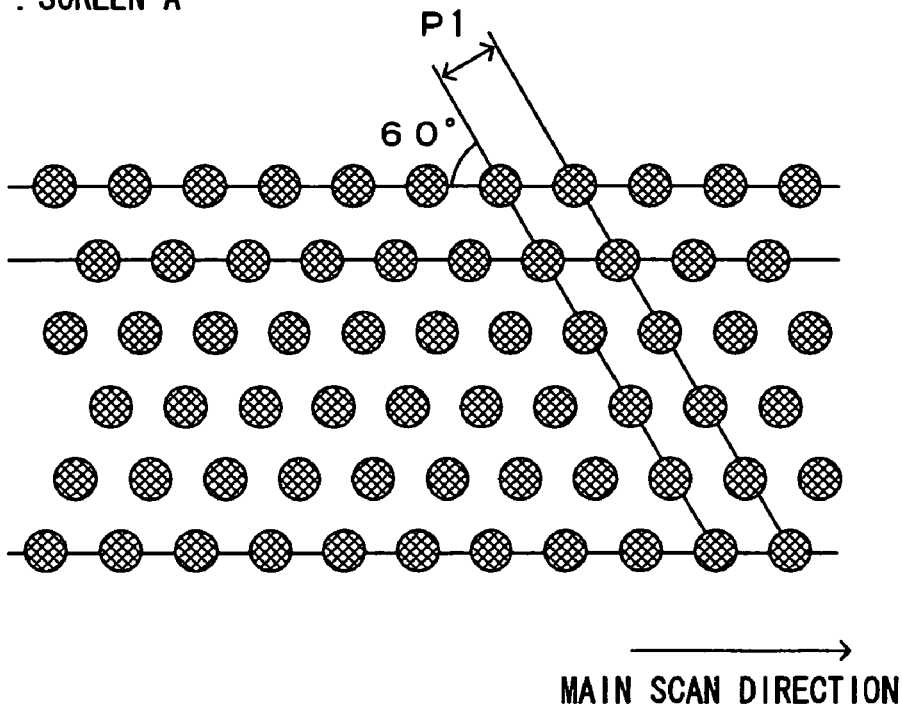
FIG. 4B : SCREEN B
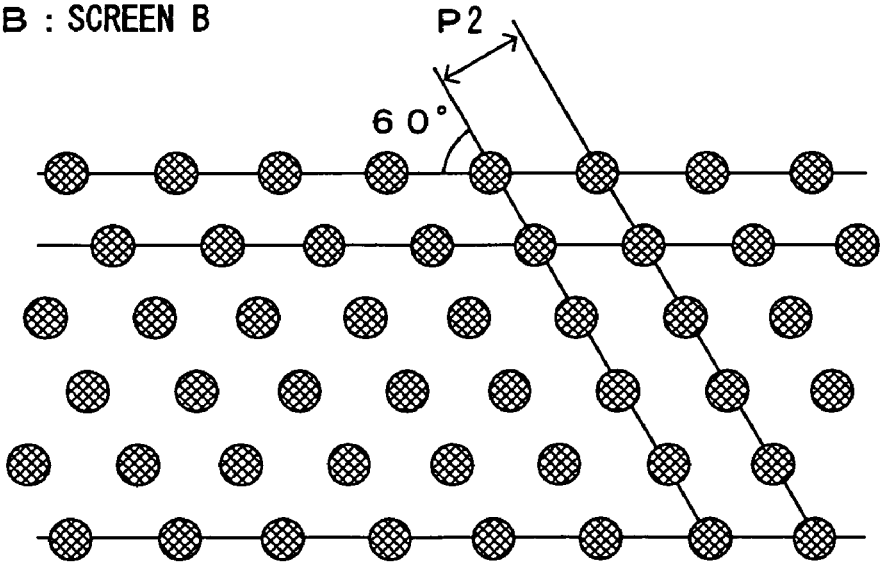

FIG. 21

| CALL | NATURE OF EXPECTED MALFUNCTION |
|---|---|
| A | CONTAMINATED WINDOW OF EXPOSURE UNIT |
| B | FAILURE OF HIGH-VOLTAGE SOURCE |
| C | FAILUER IN IMAGE FORMING OPERATION |
| D | MALFUNCTION OF TRANSFER UNIT |

IMAGE FORMING APPARATUS AND CONTROL METHOD THEREOF

CROSS REFERENCE TO RELATED APPLICATION

The disclosure of Japanese Patent Applications enumerated below including specifications, drawings and claims is incorporated herein by reference in its entirety:

No. 2005-101220 filed on Mar. 31, 2005;

No. 2005-101221 filed on Mar. 31, 2005;

No. 2005-101222 filed on Mar. 31, 2005; and

No. 2005-364520 filed on Dec. 19, 2005.

BACKGROUND

1. Technical Field

The present invention relates to an image forming apparatus for forming an image by using a toner and a control method thereof.

2. Related Art

In electrophotographic image forming apparatuses, such as printers, copiers and facsimiles, which form images by using the toner, the following procedure is adopted to ensure a predetermined image quality in a consistent manner. As required, a small test image having a predetermined image pattern (patch image) is formed while a density of the image is detected by a density sensor. Operation conditions of individual parts of the apparatus are adjusted based on the detection results.

According to an image forming apparatus set forth in Japanese Unexamined Patent Publication No. 2000-333012 previously disclosed by the present inventors, a tone correction characteristic of the apparatus is controlled based on the detected density of the patch image. Specifically, the densities of the test images of the predetermined pattern are detected by a patch sensor. Then, a gamma characteristic of the apparatus is acquired from the detection results so as to prepare a look-up table for tone correction. With reference to the look-up table thus prepared anew, an image signal is converted into data related to a pulse width to drive an exposure laser. As a result, an optimum print output may be obtained, coping with the variations of the gamma characteristic of the apparatus.

In order to avoid the consumption of a recording material each time an adjusting operation is performed, the general image forming apparatuses adopt a scheme wherein the densities of the test images carried on an internal transfer medium, such as a photosensitive member, a transfer belt or a transfer drum, are detected by means of the density sensor. However, the density of the test image temporarily carried on the transfer medium is not exactly the same as that of the test image finally transferred and fixed to the recording material.

In addition, the inventors have obtained the following finding. In an image forming apparatus of an arrangement wherein an image signal applied from an external source is subjected to a screening process selectively using one of plural types of processing screens previously prepared, the difference between the image density on the transfer medium and the image density on the recording material also varies depending upon the type of processing screen used.

A tone correction technique used in the conventional image forming apparatus involves errors resulting from such a difference between the image density on the transfer medium and the image density on the recording material. Hence, the technique leaves room for further improvement from the standpoint of ensuring the highest quality of the final image on the recording material such as recording paper.

The image forming apparatus of this type needs to keep track of the consumption or residual quantity of toner for convenience of maintenances such as toner replenishment. In some cases, the image signal may be used for this purpose. Since the image signal contains information indicative of a color and a density value of an image to be formed, how much toner is consumed by the image to be formed may be determined based on the information. A large number of proposals have heretofore been made on a technique for determining the toner consumption (hereinafter, referred to as "toner counting technique"). However, it is not easy to determine the toner consumption with high accuracies because of the errors encountered by the aforementioned tone correction technique or the variations of the characteristics of the apparatus. In this connection, the present inventors have disclosed a technique of correcting a toner count given by a toner counter, such as to deal with a case where the errors of the toner counter cannot be completely eliminated (see Japanese Unexamined Patent Publication No. 2004-354666).

According to this technique, when a residual quantity of toner in a toner cartridge, as indicated by a toner count, is not more than a half of an initial value and when a density of a toner image formed as the patch image is lower than a predetermined density, the toner count is so corrected as to be regarded as a toner end even though the toner count indicates some quantity of toner remains in the toner cartridge.

The image forming apparatus of this type may potentially encounter an event of density deficiency, which may be caused by the other factors than the toner end, which include the operation of the apparatus under severe environments such as of high temperature and high moisture, unexpected malfunction of the apparatus, and the like. However, the above conventional technique has the following problem. In a case where such an unexpected density deficiency occurs with the toner count increased to some degree, the density deficiency is necessarily attributed to the toner end irrespective of a real cause of the density deficiency. As a result, even a serviceable toner cartridge actually storing a sufficient quantity of toner may be regarded as unserviceable and may fall out of use in the subsequent image forming operation. Otherwise, a proper troubleshooting may not be performed on the malfunction of the apparatus.

SUMMARY

A first object of the invention is to improve the quality of the image on the recording material by enhancing correlation between the image signal indicative of the contents of the image to be formed and the density of the image finally transferred to the recording material, as well as to increase the accuracy of calculation of the toner consumption based on the image signal. A second object of the invention is to provide proper management of the service life of the toner cartridge and proper management of the apparatus based on the calculation result of the toner consumption.

According to a first aspect of the invention, an image forming apparatus for forming an image corresponding to an image signal on a recording material comprises: a signal processor which generates an image-formation control signal by subjecting the image signal to a signal processing process including a screening process selectively using one of plural types of different processing screens; an image forming unit which includes an intermediate transfer medium, and which forms the image by forming a toner image on the intermediate transfer medium corresponding to the image-formation control signal and transferring and fixing the toner image to a recording material; and a detector which detects a quantity of the toner carried on the intermediate transfer medium as the toner image, wherein the signal processing process performed by the signal processor includes a tone correction process for compensating for a gamma characteristics of the apparatus based on a detection result given by the detector detecting a toner image formed as a patch image by using the processing screen and a transferring/fixing characteristics previously determined in correspondence to the processing screen.

A control method of the image forming apparatus according to the first aspect of the invention comprises: a signal processing step of generating an image-formation control signal by subjecting an image signal to a signal processing process including a screening process selectively using one of plural types of different processing screens; an image forming step of forming a toner image corresponding to the image-formation control signal and making the toner image be carried on an intermediate transfer medium; and a transferring/fixing step of transferring and fixing the toner image, carried on the intermediate transfer medium, to a recording material, wherein the signal processing step includes a tone correction process for compensating for a gamma characteristics of the apparatus based on a detection result given by a detector detecting a quantity of toner constituting a toner image formed as a patch image by using the selected processing screen and carried on the intermediate transfer medium and a transferring/fixing characteristics previously determined in correspondence to the processing screen.

It is noted here that the transferring/fixing characteristics mean characteristics representing a relation between a quantity of toner constituting the toner image carried on the intermediate transfer medium and a density of an image formed on the recording material as the result of transferring and fixing the toner image to the recording material.

The conventional tone correction technique does not consider a difference between a detected quantity of toner on the intermediate transfer belt and a density of the final image on the recording material. As a result, there may be a case where the image on the recording material does not necessarily have the best quality. In the above constitution, however, the tone correction process is performed counting in not only the detected quantity of toner on the intermediate transfer belt but also the transferring/fixing characteristics representing the relation between the quantity of toner on the intermediate transfer belt and the image density on the recording material. By doing so, the image quality on the recording material can be improved because the image density on the recording material rather than on the intermediate transfer medium is fed back to the processing contents of the tone correction process. What is more, the tone correction process is performed on each of the processing screens, giving consideration to that the transferring/fixing characteristics vary depending upon the type of the used processing screen. That is, the contents of the tone correction process are discretely defined on a per-processing-screen basis and are also decided based on the detection result of the patch image formed by using the corresponding processing screen and on the transferring/fixing characteristics corresponding to the processing screen. Thus, the image quality may be further improved. Furthermore, the correlation between the image signal and the quantity of toner adhered to the recording material is enhanced. Therefore, in a case where the toner consumption is determined based on the image signal, the calculation accuracies may be increased.

According to a second aspect of the invention, an image forming apparatus comprises: a toner cartridge storing a toner; an image forming unit which forms a toner image with the toner supplied from the toner cartridge; and a counter which counts a consumption of the toner in the toner cartridge. According to the apparatus and a control method thereof for achieving the second object mentioned above, when a density of a first toner image formed by the image forming unit is lower than a first density previously defined in correspondence to the first toner image, whether the correction of a count value counted by the counter is necessary or not is determined based on a quantity of the toner in the toner cartridge as determined from the count value of the counter and index information indicating a status of the apparatus except for the toner cartridge. If it is determined that the correction of the count value is necessary, the count value of the counter is corrected.

In the case where the density of the formed toner image is lower than the predetermined density, whether the count value need be corrected or not is determined based on both of the information items including the count value indicating the toner consumption and the index information indicating the status of the apparatus. In contrast to the example where the count value is forcibly corrected in response to a judgment result based on only the count value indicating the toner consumption, this scheme obviates a problem that the count value is corrected although the toner cartridge is serviceable. Hence, the toner cartridge may be used subsequently under a proper management, as prevented from being regarded as unserviceable. According to the above constitution, therefore, the service live of the toner cartridge may be managed more properly.

According to a third aspect of the invention, an image forming apparatus comprises: a toner cartridge storing a toner; an image forming unit which forms a toner image with the toner supplied from the toner cartridge; a counter which counts a consumption of the toner in the toner cartridge; and a controller which in the event of a density deficiency that a density of a first toner image formed by the image forming unit is lower than a first density defined in correspondence to the first toner image, determines whether the density deficiency is a result of an insufficient residual quantity of the toner in the toner cartridge or a result of an operation error of any other part of the apparatus based on index information indicating a status of the apparatus, and which performs a predetermined error handling process when determining the density deficiency to be the result of the operation error.

According to the third aspect of the invention, a control method of an image forming apparatus including: the toner cartridge storing the toner; the image forming unit for forming a toner image with the toner supplied from the toner cartridge; and the counter for counting a consumption of the toner in the toner cartridge, comprises the steps of: a detection step of a first toner image formed by the image forming unit; a judgment step of determining whether a density deficiency that the density of the first toner image is lower than a first density defined in correspondence to the first toner image happens or not, and determining whether the density deficiency is a result of an insufficient residual quantity of the toner in the toner cartridge or a result of an operation error of any other part of the apparatus; and an error handling step of performing a predetermined error handling process when it is determined in the judgment step that the density deficiency is the result of the operation error.

According to the constitution, in the case where the density of the formed toner image is lower than the predetermined density, whether the cause of the density deficiency lies in the toner cartridge or in any other part of the apparatus is determined. This approach permits the subsequent process to be performed properly according to the cause of the density deficiency. Thus, the invention is adapted to eliminate those problems that the serviceable toner cartridge is regarded as unserviceable and that a proper action against a malfunction of the apparatus is not taken. What is more, the proper management of the apparatus including the toner cartridges may be ensured.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

BRIEF DESCRIPTION OF THE DRAWINGS

FIG. 4A and FIG. 4B are drawings which illustrate screens for halftoning process;

FIG. 21 is a table which shows the types of the service calls.

DETAILED DESCRIPTION OF THE PREFERRED EMBODIMENTS

First Embodiment

Figure 1:
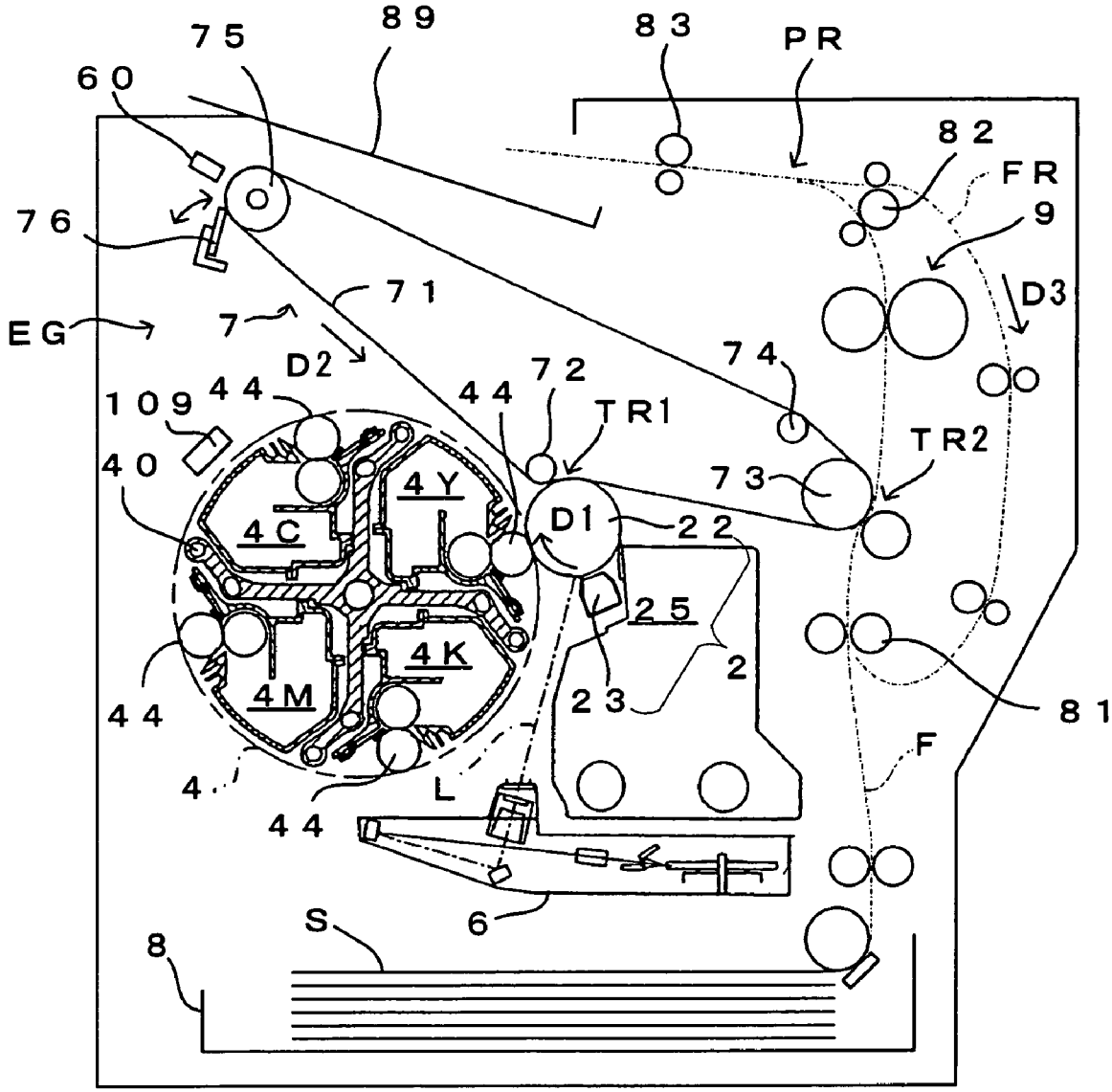
FIG. 1 is a drawing which shows a first embodiment of the image forming apparatus according to the invention.
Figure 2:
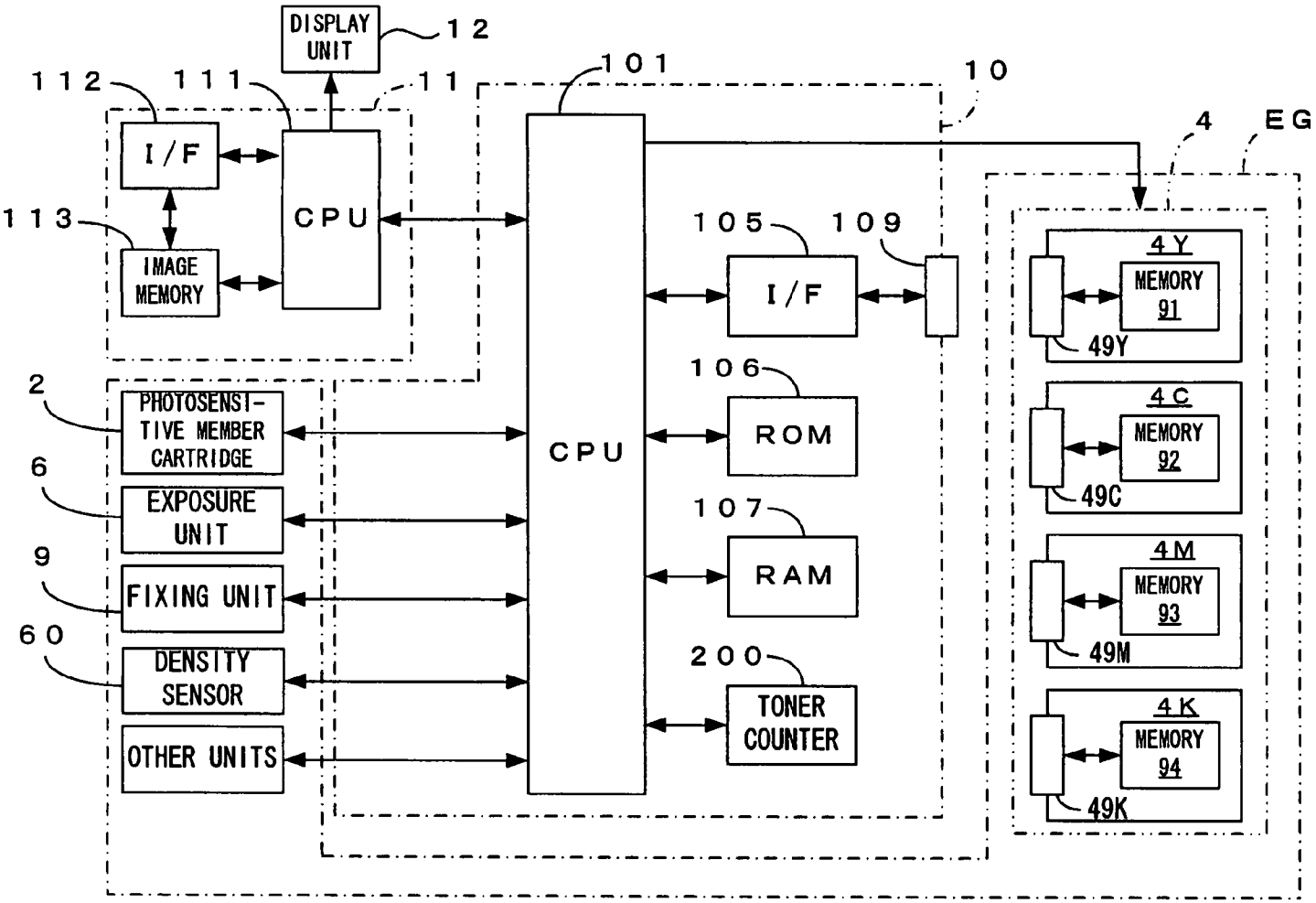
FIG. 2 is a block diagram of the electric structure of the image forming apparatus shown in FIG. 1.

FIG. 1 is a drawing which shows a first embodiment of the image forming apparatus according to the invention. FIG. 2 is a block diagram of the electric structure of the image forming apparatus shown in FIG. 1. The illustrated apparatus is an apparatus which overlays toner in four colors of yellow (Y), cyan (C), magenta (M) and black (K) one atop the other and accordingly forms a full-color image, or forms a monochrome image using only black toner (K). In the image forming apparatus, when an image signal is fed to a main controller 11 from an external apparatus such as a host computer, a predetermined image forming operation is performed. That is, an engine controller 10 controls respective portions of an engine part EG in accordance with an instruction received from the main controller 11, and an image which corresponds to the image signal is formed on a sheet S.

In the engine part EG, a photosensitive member 22 is disposed so that the photosensitive member 22 can freely rotate in the arrow direction D1 shown in FIG. 1. Around the photosensitive member 22, a charger unit 23, a rotary developer unit 4 and a cleaner 25 are disposed in the rotation direction D1. A predetermined charging bias is applied upon the charger unit 23, whereby an outer circumferential surface of the photosensitive member 22 is charged uniformly to a predetermined surface potential. The cleaner 25 removes toner which remains adhering to the surface of the photosensitive member 22 after primary transfer, and collects the toner into a used toner tank which is disposed inside the cleaner 25. The photosensitive member 22, the charger unit 23 and the cleaner 25, integrated as one, form a photosensitive member cartridge 2. The photosensitive member cartridge 2 can be freely attached to and detached from a main section of the apparatus as one integrated unit.

An exposure unit 6 emits a light beam L toward the outer circumferential surface of the photosensitive member 22 which is thus charged by the charger unit 23. The exposure unit 6 makes the light beam L expose on the photosensitive member 22 in accordance with an image signal fed from the external apparatus and forms an electrostatic latent image which corresponds to the image signal.

The developer unit 4 develops thus formed electrostatic latent image with toner. The developer unit 4 comprises a support frame 40 which is disposed for free rotations about a rotation shaft which is perpendicular to the plane of FIG. 1, and also comprises a yellow developer 4Y, a cyan developer 4C, a magenta developer 4M and a black developer 4K which house toner of the respective colors and are formed as cartridges which are freely attachable to and detachable from the support frame 40. The engine controller 10 controls the developer unit 4. The developer unit 4 is driven into rotations based on a control instruction from the engine controller 10. When the developers 4Y, 4C, 4M and 4K are selectively positioned at a predetermined developing position which abuts on the photosensitive member 22 or is away a predetermined gap from the photosensitive member 22, toner of the color corresponding to the selected developer is supplied onto the surface of the photosensitive member 22 from a developer roller 44 disposed to the selected developer which carries toner of this color and has been applied with the predetermined developing bias. As a result, the electrostatic latent image on the photosensitive member 22 is visualized in the selected toner color.

A toner image developed by the developer unit 4 in the manner above is primarily transferred onto an intermediate transfer belt 71 of a transfer unit 7 in a primary transfer region TR1. The transfer unit 7 comprises the intermediate transfer belt 71 which runs across a plurality of rollers 72 through 75, and a driver (not shown) which drives a roller 73 into rotations to thereby rotate the intermediate transfer belt 71 along a predetermined rotation direction D2. For transfer of a color image on the sheet S, toner images in the respective colors on the photosensitive member 22 are superposed one atop the other on the intermediate transfer belt 71, thereby forming a color image. Further, on the sheet S unloaded from a cassette 8 one at a time and transported to a secondary transfer region TR2 along a transportation path F, the color image is secondarily transferred.

At this stage, for the purpose of correctly transferring the image held by the intermediate transfer belt 71 onto the sheet S at a predetermined position, the timing of feeding the sheet S into the secondary transfer region TR2 is managed. To be more specific, there is a gate roller 81 disposed in front of the secondary transfer region TR2 on the transportation path F. As the gate roller 81 rotates in synchronization to the timing of rotations of the intermediate transfer belt 71, the sheet S is fed into the secondary transfer region TR2 at predetermined timing.

Further, the sheet S now bearing the color image is transported to a discharge tray 89, which is disposed to a top surface of the main section of the apparatus, through a fixing unit 9, a pre-discharge roller 82 and a discharge roller 83. Meanwhile, when images are to be formed on the both surfaces of the sheet S, the discharge roller 83 starts rotating in the reverse direction upon arrival of the rear end of the sheet S, which carries the image on its one surface as described above, at a reversing position PR located behind the pre-discharge roller 82, thereby transporting the sheet S in the arrow direction D3 along a reverse transportation path FR. While the sheet S is returned back to the transportation path F again before arriving at the gate roller 81, the surface of the sheet S which abuts on the intermediate transfer belt 71 in the secondary transfer region TR2 and is to receive a transferred image is at this stage opposite to the surface which already bears the image. In this fashion, it is possible to form images on the both surfaces of the sheet S.

Further, there is a cleaner 76 in the vicinity of the roller 75. The cleaner 76 can be attached to and detached from the intermediate transfer belt 71 driven by an electromagnetic clutch not shown. When abutting on the intermediate transfer belt 71 as needed, the cleaner 76 scrapes off the toner remaining on the intermediate transfer belt 71.

Furthermore, a density sensor 60 is disposed in the vicinity of the roller 75. The density sensor 60 confronts a surface of the intermediate transfer belt 71 so as to measure, as needed, the density of the toner image formed on an outside surface of the intermediate transfer belt 71. Based on the measurement results, the apparatus adjusts the operating conditions of the individual parts thereof, the operating conditions affecting the image quality. The operating conditions include, for example, a developing bias applied to each developer, the intensity of the light beam L and the like.

The density sensor 60 employs, for example, a reflective photosensor for outputting a signal corresponding to a density value of a region of a given area defined on the intermediate transfer belt 71. The CPU 101 is adapted to detect image densities of individual parts of the toner image on the intermediate transfer belt 71 by periodically sampling the output signals from the density sensor 60 as revolving the intermediate transfer belt 71. The term "image density" of the toner image, as used herein, means the density value of the toner image temporarily carried on the intermediate transfer belt 71, or the magnitude of quantity of toner constituting the toner image. That is, the "image density" is not equivalent to an image density (optical density) of the toner image finally transferred and fixed to the sheet S. A detailed description will be made on this respect hereinlater.

As shown in FIG. 2, the individual developer cartridges 4Y, 4C, 4M and 4K are provided with respective memories 91 to 94 for storing data related to a production lot, operation history, a residual quantity of stored toner and the like. The developer cartridges 4Y, 4C, 4M and 4K are further provided with respective wireless communication devices 49Y, 49C, 49M, 49K. Whenever necessary, any selected one of these communication devices performs non-contact data communications with a wireless communication device 109 disposed in the apparatus body. Thus, data transmission/reception via an interface 105 is carried out between the CPU 101 and each of the memories 91 to 94, so that the CPU can manage a variety of information items such as related to a consumable article of the corresponding developer cartridge. The embodiment employs the electromagnetic member such as the wireless communication device for carrying out the non-contact data transmission/reception. Alternatively, the apparatus body and the individual developer cartridges may be provided with connectors or the like so that a respective pair of corresponding connectors may be mechanically fitted with each other for carrying out the data transmission/reception between the apparatus body and the individual developer cartridges.

As shown in FIG. 2, the apparatus further includes a display unit 12 controlled by a CPU 111 of the main controller 11. The display unit 12 comprises, for example, a liquid crystal display. According to a control command from the CPU 111, the display unit 12 displays a predetermined message to inform a user of operation guide or the progress of the image forming operation, or to inform the user of the occurrence of a failure in the apparatus or time to replace any one of the units.

In FIG. 2, indicated at 113 is an image memory disposed in the main controller 11 for storing an image data supplied from the external apparatus, such as the host computer, via an interface 112. Indicated at 106 is a ROM for storing a computation program executed by the CPU 101 and control data used for controlling the engine EG. Indicated at 107 is a RAM for temporarily storing computation results given by the CPU 101 and other data.

Indicated at 200 is the toner counter for determining toner consumption. The toner counter 200 calculates, on a per-toner-color basis, a quantity of toner consumed in the execution of the image forming operation and then, stores the calculation result. A method of calculating the toner consumption is optional and any of the known techniques may be applied. For instance, the image signal inputted from the external apparatus may be analyzed to count the number of toner dots to be formed on a per-color basis, so as to calculate the toner consumption from the count value.

The CPU 101 subtracts the per-color toner consumption, determined by the toner counter 200, from an initial quantity of toner stored in each of the developers 4Y and the like, thereby determining the current residual quantity of toner in each developer. As required, the CPU 101 directs the display unit 12 to display a message informing the user of the residual quantity of toner of each color or of the toner end.

Figure 3:
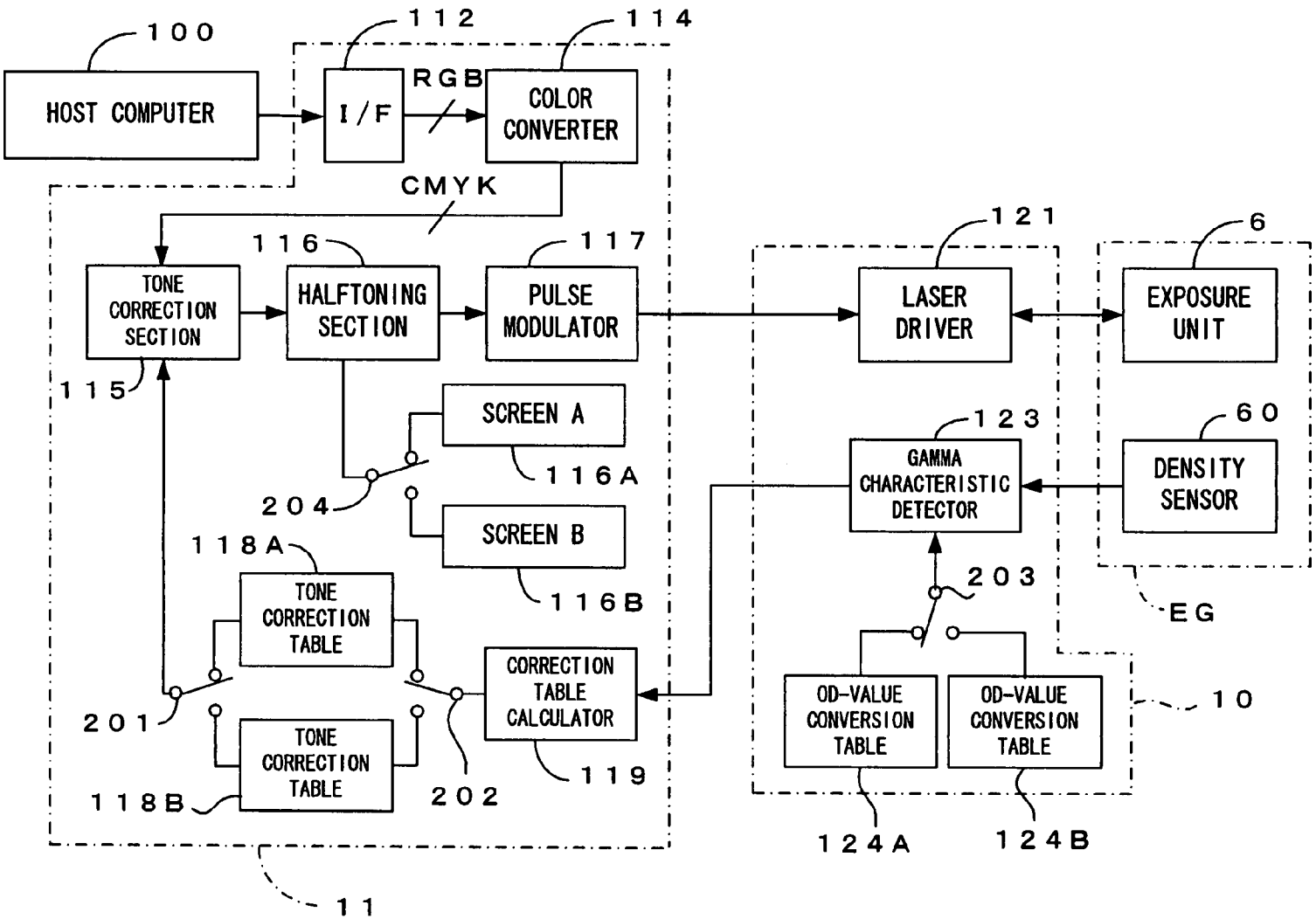
FIG. 3 is a diagram which shows a tone processing block of the image forming apparatus.

FIG. 3 is a diagram which shows a tone processing block of the image forming apparatus. The main controller 11 includes function blocks such as a color converter 114, a tone correction section 115, a halftoning section 116, a pulse modulator 117, tone correction tables 118A, 118B and a tone-correction table calculator 119.

In addition to the CPU 101, ROM 106 and RAM 107 shown in FIG. 2, the engine controller 10 further includes a laser driver 121 for driving a laser light source disposed at the exposure unit 6, and a gamma characteristic detector 123 for detecting a gamma characteristic of the engine EG based on the detection result given by the density sensor 60.

In the main controller 11 supplied with an image signal from a host computer 100, the color converter 114 converts RGB tone data into CMYK tone data, the RGB tone data representing the respective tone levels of RGB components of each pixel in an image corresponding to the image signal, the CMYK tone data representing the respective tone levels of CMYK components corresponding to the RGB components. The color converter 114 processes the input RGB tone data comprising, for example, 8 bits per color component for each pixel (or representing 256 tone levels), whereas the output CMYK tone data similarly comprise 8 bits per color component for each pixel (or representing 256 tone levels). The CMYK tone data outputted from the color converter 114 are inputted to the tone correction section 115.

The tone correction section 115 performs tone correction on the CMYK tone data per pixel, which are inputted from the color converter 114. Specifically, the tone correction section 115 refers to either one of the two tone correction tables 118A, 118B previously stored in a non-volatile memory, and converts the per-pixel CMYK tone data inputted from the color converter 114 into corrected CMYK tone data according to the tone correction table, the corrected CMYK tone data representing corrected CMYK tone levels. An object of the tone correction is to compensate for the variations of the gamma characteristic of the engine EG of the above arrangement, thereby to maintain the general gamma characteristic of the image forming apparatus in an idealistic state at all times.

The corrected CMYK tone data thus corrected are inputted to the halftoning section 116. The halftoning section 116 subjects the inputted tone data to a halftoning process based on a screening process, thereby generating halftoned CMYK tone data comprising 8 bits per color component for each pixel. The resultant halftoned data are inputted to the pulse modulator 117. The contents of the halftoning process vary depending upon the type of image to be formed. Based on criteria for identification of monochromatic image, color image, line drawing or graphic image, a processing screen most suited to the image of interest is selected from plural types of processing screens previously prepared (two types of screens 116A, 116B are prepared in this example) by a selector switch 204 and the halftoning process is performed using the selected screen.

FIG. 4A and FIG. 4B are drawings which illustrate screens for halftoning process. A first screen (screen A indicated at 116A in FIG. 3) shown in FIG. 4A is suited to an image of high resolutions. Specifically, the screen A has a halftone dot pattern wherein dot arrays are inclined at an angle of 60° relative to a scanning direction (main scanning direction) of the light beam L on the photosensitive member 22, and has a smaller halftone-dot pitch P1 than that of the screen B which will be described hereinlater. Having a relatively fine pitch P1, the screen A is suited to the image of high resolutions, such as a character-base image.

On the other hand, a second screen (screen B indicated at 116B in FIG. 3) shown in FIG. 4B has a halftone dot pattern wherein the dot lines are similarly inclined at the angle of 60°, but has a greater dot pitch P2 than that of the screen A. Hence, the screen B is superior to the screen A in terms of halftone expression. That is, the screen B is suited to a photographic image, scenic image and graphic image.

The halftoning section 116 identifies the type of the image to be formed based on the input image signal and selects one of the aforesaid two screens, which is more suited to the image to be formed. Using the selected screen, the halftoning section performs the halftoning process. In the formed image, therefore, toner dots are arranged in arrays with a period corresponding to the pitch of the applied screen. Hence, a distance between toner dots also corresponds to this pitch. The screens are not limited to the above two types and may further include other screens having different inclination angles or pitches.

This embodiment is provided with the two tone correction tables 118A, 118B corresponding to the two screens A and B respectively, such as to deal with the following problem. Tone levels of the output image formed in correspondence to the input tone levels define a non-linear characteristic curve. What is more, the characteristic curve subtly varies depending upon the type of a used screen. Thus, the plural tone correction tables are provided in correspondence to the respective screens of different patterns, whereby excellent tone reproduction is ensured whichever of the two screens may be selected. In this embodiment, when a screen to be used in the halftoning process is decided, one of the two tone correction tables 118A, 118B, which corresponds to the screen to be used, is selected by a switching member 201. Then, the aforementioned tone correction is performed based on the selected table.

The halftoned CMYK tone data inputted to the pulse modulator 117 are represented by multivalued signals which indicate respective dot sizes of CMYK color toners to be made to adhere to each pixel and an array of the color toner dots. Receiving such data, the pulse modulator 117 uses the halftoned CMYK tone data to generate a video signal for pulse width modulation of exposure laser pulses used by the engine EG to form each of the CMYK color images. The pulse modulator 117 outputs the video signal to the engine controller 10 via an unillustrated video interface. In response to the video signal, the laser driver 121 provides ON/OFF control of a semiconductor laser of the exposure unit 6, thereby forming an electrostatic latent image of each color component on the photosensitive member 22. In this manner, the image corresponding to the image signal is formed.

In the image forming apparatuses of this type, the gamma characteristic varies from one apparatus to another. In addition, the apparatus per se encounters the variations of the gamma characteristic thereof according to the use conditions thereof. In order to eliminate the influences of the varied gamma characteristics on the image quality, a tone control process is performed in a predetermined timing so as to update the contents of the above tone correction table based on the measurement results of image density. In this embodiment, the two types of tone correction tables 118A, 118B are provided in correspondence to the two types of screens, respectively. The tone control process described as below is discretely performed on each of the tone correction tables. Specifically, an output from the tone-correction table calculator 119 is applied to either one of the tone correction tables 118A, 118B by means of a switching member 202 operatively associated with the switching member 201. The selected tone correction table corresponds to the used screen.

Figure 5:
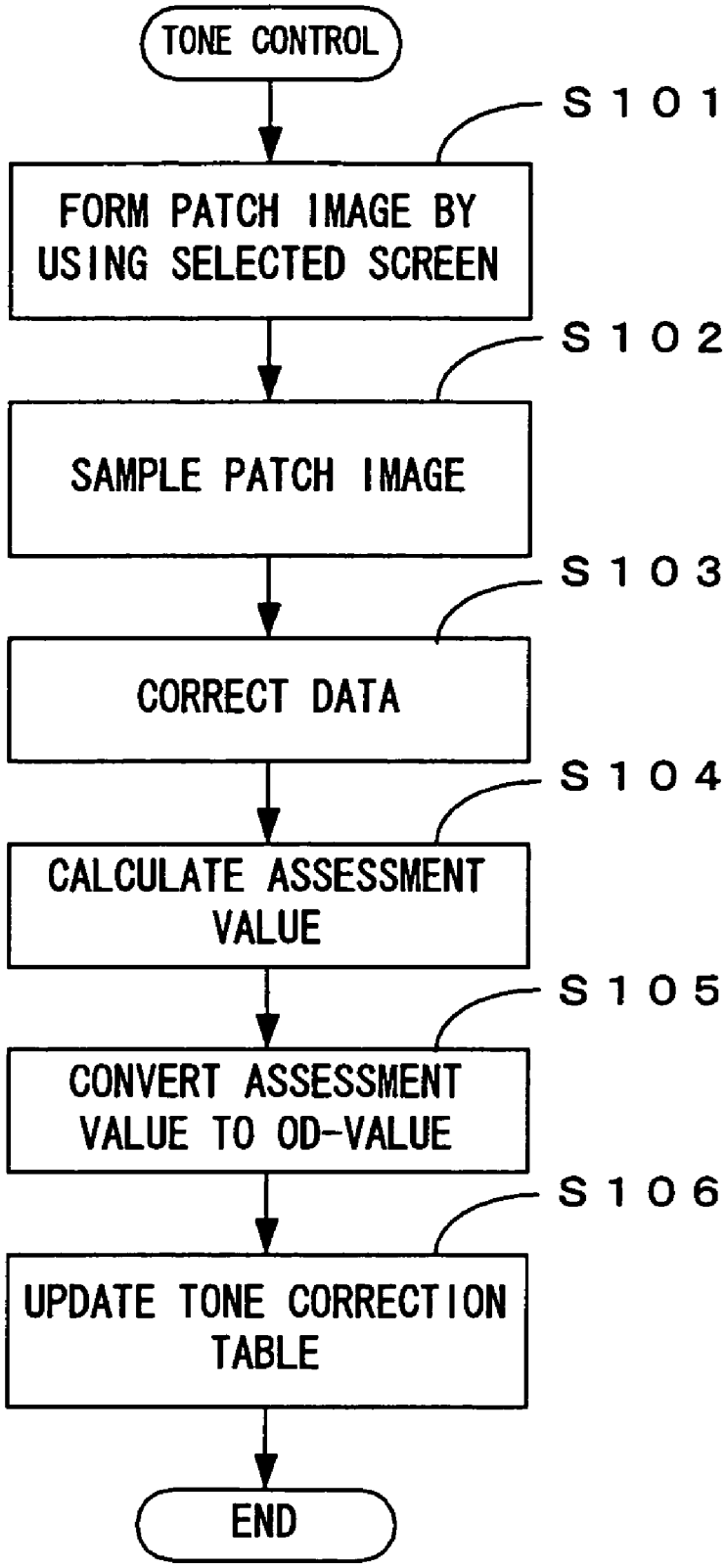
FIG. 5 is a flow chart which shows the steps of the tone control process.

FIG. 5 is a flow chart which shows the steps of the tone control process. The gamma characteristic of the engine EG does not stay constant at all times but varies with time. Hence, the tone correction section 115 must alter the contents of the aforesaid tone correction according to the varied characteristics of the apparatus. The embodiment satisfies this need by appropriately updating the tone correction tables 118A, 118B according to the varied characteristics of the apparatus. The update of the tone correction table 118A, 118B is accomplished by performing the tone control process shown in FIG. 5. In this tone control process, a patch image of a predetermined image pattern is first formed (Step S101). In this process, an image signal corresponding to the patch image is subjected to the halftoning process using the screen corresponding to the tone correction table to be updated. Specifically, the tone control process for updating the tone correction table 118A subjects the image signal to the halftoning process using the screen A corresponding to the table of interest. Likewise, the tone control process for updating the tone correction table 118B uses the screen B corresponding to the table of interest. In this manner, the tone correction process based on the actual status of the apparatus may be implemented by forming the patch image using the corresponding screen. Hence, the excellent reproduction may be achieved.

Figure 6A:
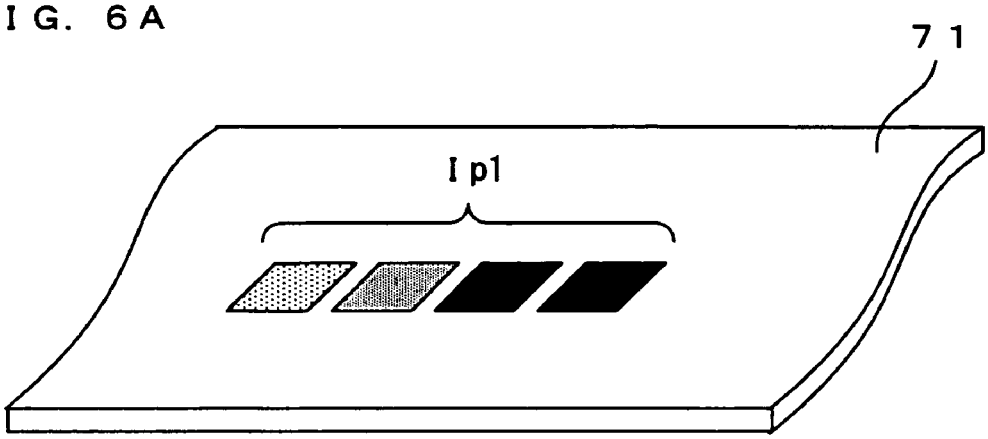
FIG. 6A and FIG. 6B are diagrams which show examples of the patch image.
Figure 6B:
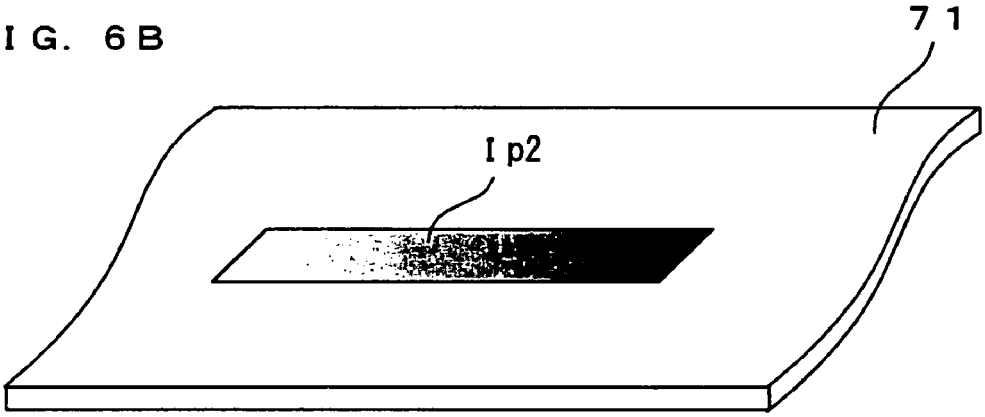

FIG. 6A and FIG. 6B are diagrams which show examples of the patch image. The patch image used in the tone control process may preferably be an image having plural tone levels. For example, there may be used a patch image Ip1, as shown in FIG. 6A, which includes plural patch image pieces having mutually different tone levels, or a patch image Ip2, as shown in FIG. 6B, which consists of a continuous image wherein the tone level is progressively varied. In the example of FIG. 6A, the individual patch image pieces may be formed in adjoining relation. In addition, the following point may be taken into consideration.

Figure 7:
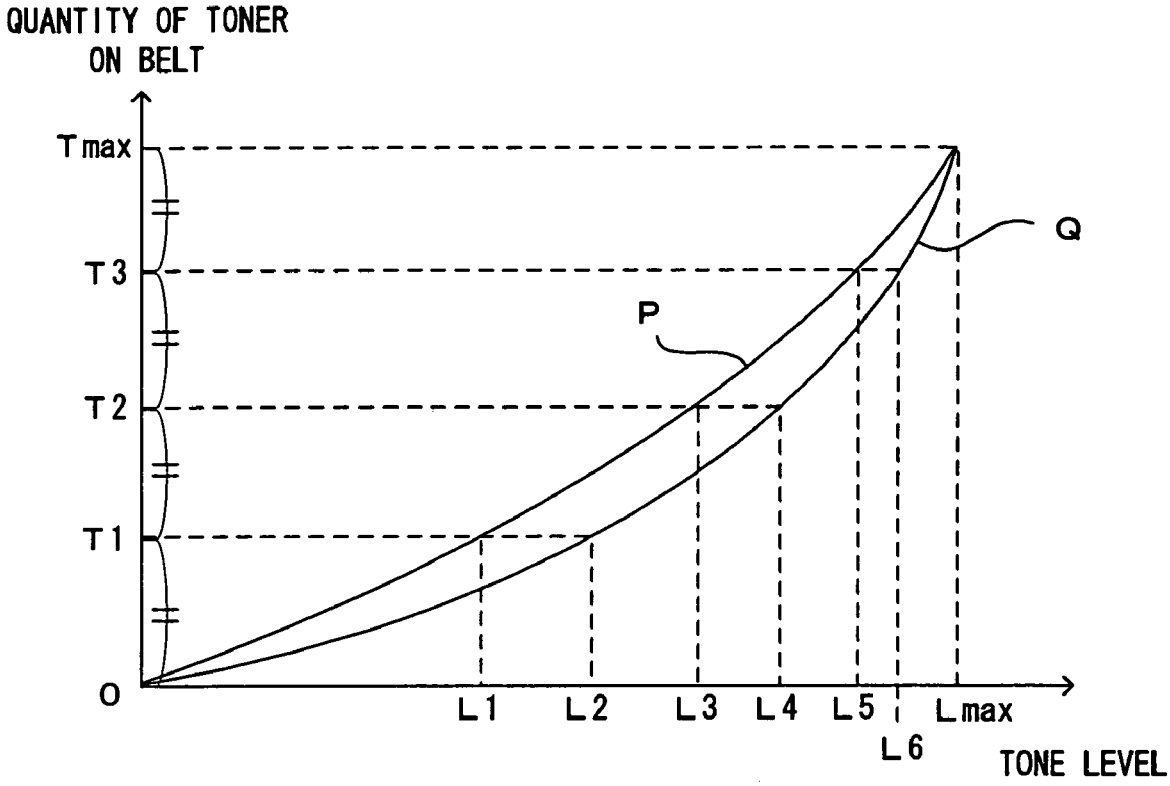
FIG. 7 is a graph which shows a relation between the input tone level and the quantity of toner constituting the image.

FIG. 7 is a graph which shows a relation between the input tone level and the quantity of toner constituting the image. As described above, the non-linear relation exists between the input tone level and the quantity of toner constituting the actually visualized image. In order that the whole characteristic curve under such a relation is accurately extrapolated from the detected toner quantities of the patch image formed at some typical tone levels, the respective tone levels of the patch pieces must be selected carefully. Under the relation of tone level versus toner quantity, it is preferred that the tone levels are varied in wider steps in a curve region having smaller inclination whereas the tone levels are varied in narrower steps in a curve region having greater inclination. More specifically, a schematic curve configuration may be extrapolated with certain degree of accuracies. Hence, the respective tone levels of the patch pieces may preferably be decided in a manner that the toner quantities of the patch pieces as indicated by the extrapolated curve are distributed on the toner quantity axis of FIG. 7 substantially at equal intervals. The curve configuration also varies depending upon the type of the screen. Therefore, it is also preferred that the tone levels of the patch pieces to be formed are decided in correspondence to each type of screen.

In a case where the patch image Ip1 consisting of the four patch pieces is formed using a screen having a characteristic represented by a curve P shown in FIG. 7, for example, it is desirable to form the patch pieces at respective tone levels L1, L3, L5, Lmax such that the respective toner quantities T1, T2, T3, Tmax of the patch pieces may be distributed substantially at equal intervals. Likewise, in a case where the patch pieces are formed using a screen having a characteristic represented by a curve Q shown in FIG. 7, it is desirable to form the patch pieces at respective tone levels L2, L4, L6, Lmax.

Returning to FIG. 5, the tone control process is further described. A signal outputted from the density sensor 60 detecting each tone level of the patch image thus formed is sampled (Step S102). In cases, these sampled data pieces may suffer noise invasion. Hence, an appropriate data correction process is performed (Step S103). The data correction is a process for reducing the influence of the noises on the detection results. However, the process is not an essential matter of the invention and hence, a detailed description thereof is dispensed with.

The density sensor 60 outputs a signal, whose level is varied according to the quantity of light reflected from the intermediate transfer belt 71 opposite to which the sensor 60 is disposed. Specifically, the greatest quantity of light is reflected from a surface of the intermediate transfer belt 71 absolutely free from toner adhesion. With the increase of the quantity of toner covering the belt surface, the quantity of reflected light is decreased. Therefore, the level of the output from the density sensor 60 is at maximum when the intermediate transfer belt 71 is absolutely free from toner, and is generally lowered as the quantity of adhered toner increases (in the case of the black toner). In the case of a color toner, however, the level of the output signal may conversely be increased in a region where a large quantity of toner is adhered. In the patch image constituted by the toner adhered to the intermediate transfer belt 71, the image density increases as the quantity of adhered toner increases. Thus, the level of the output signal from the density sensor 60 is far from directly reflecting the density of the patch image.

Hence, the embodiment adopts the following "assessment value" of the patch image as a numerical value more directly reflecting the density of the patch image (Step S104). This assessment value takes on zero when the density of the patch image is at zero, or when there is not toner. The assessment value is increased as the quantity of toner representing the patch image is increased. Specifically, the assessment value can be calculated using the following equation:

$$G=1-(Psmp-P\mathrm{min})/(P\mathrm{max}-P\mathrm{min}).$$

In the above equation, the symbol "Psmp" denotes a sampled data piece (corrected data piece) on the patch image. The symbol "Pmax" denotes a sampled data piece on the surface of the intermediate transfer belt 71 free from toner adhesion, representing the greatest value as a sensor output. The symbol "Pmin" denotes a sampled data piece on the intermediate transfer belt 71 completely covered with the toner, representing the minimum value as a sensor output.

Under such definitions, the sampled data piece Psmp takes the maximum value Pmax in a state where the intermediate transfer belt 71 is absolutely free from toner adhesion. Hence, the assessment value G is at zero. With the increase of the toner quantity, the sample data piece Psmp is decreased in value, so that the assessment value G is increased. In a state where the intermediate transfer belt 71 is completely covered with the toner, the sampled data piece Psmp takes the minimum value Pmin, so that the assessment value G takes on 1. By using the assessment value G so defined, the density of the patch image may be expressed as a normalized value ranging from 0 (corresponding to the minimum density) to 1 (corresponding to the maximum density).

To be exact, the term "image density" of the patch image, as used herein, indicates the magnitude of quantity of the toner constituting the image. As mentioned supra, the image density of the image is not equal to the density of an image formed on the sheet S as the result of transferring and fixing the image to the sheet S. The reason is as follows. In the image carried on the intermediate transfer belt 71, the toner particles constituting the image are merely made to adhere to the intermediate transfer belt 71 by means of an electrostatic force. In the image fixed to the sheet S, on the other hand, the toner is fused to the sheet S. Because of the different statuses of the toner constituting such images, the detected density of the toner image temporarily carried on the intermediate transfer belt 71 does not necessarily coincide with the final density of the image on the sheet S.

The final object of the tone correction is to ensure the highest quality of the image formed on the sheet S. For achieving this object, the contents of the tone correction process may preferably be decided by feeding back the detected densities of the patch image on the sheet S. However, it is impracticable to form the patch image on the sheet S for this purpose because the sheet S is consumed more than necessary. What is more, need arises for providing an additional member for detecting the density of the patch image fixed to the sheet S. In image forming apparatuses, such as copiers and multifunction apparatuses, which are equipped with a scanner for reading an original document, the scanner may be used for this purpose. In this case, however, the sheet S formed with the patch image must be transported to place to be read by the scanner.

In this connection, this image forming apparatus utilizes previously determined "transferring/fixing characteristics" thereof for converting the detected density of the patch image on the intermediate transfer belt 71 (assessment value) to the density of the image on the sheet S (optical density: OD value), so as to feed back the substantial density of the image on the sheet S to the tone correction process. As shown in FIG. 5, the previously determined assessment value G of the patch image on the intermediate transfer belt 71 is converted to the OD value on the sheet S (Step S105). The OD value is fed back to the tone-correction table calculator 119. The tone-correction table calculator 119, in turn, performs a predetermined calculation so as to update the contents of the tone correction table 118A, 118B in a manner to match the tone level represented by the input image signal with the actual tone level of the image on the sheet S (Step S106). In this manner, the tone control process may be performed to update the tone correction table 118A, 118B on an as-needed basis, thereby ensuring that images of good quality are consistently formed irrespective of the varied characteristics of the apparatus.

The term "transferring/fixing characteristics", as used herein, means a quantitative representation of a relation between the detected value on the intermediate transfer belt 71 as indicating the quantity of toner constituting a certain toner image (the value is equivalent to the "assessment value" of the embodiment but may also be the sampled data piece, per se, for example) and the density (optical density) of the toner image fixed to the sheet S.

Figure 8:
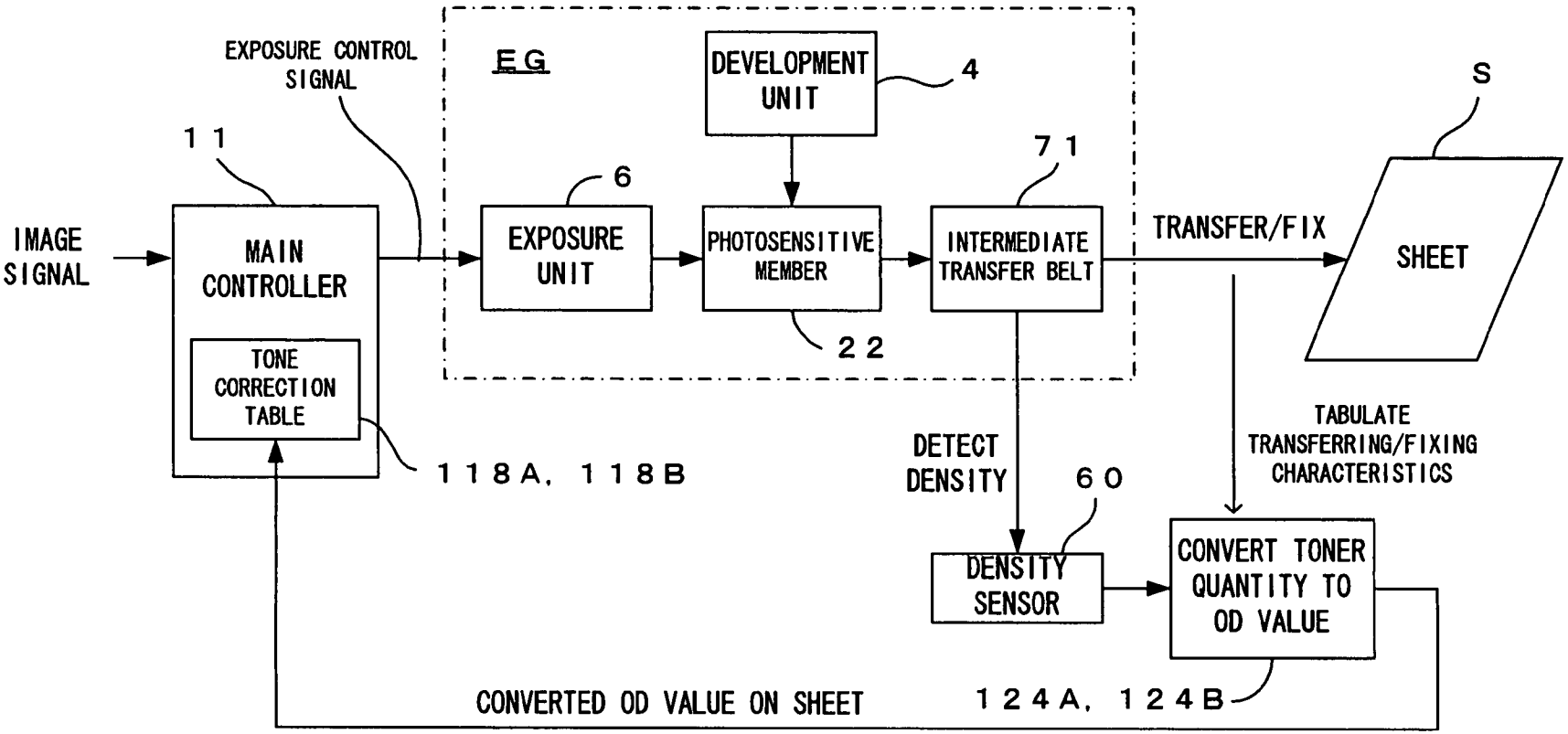
FIG. 8 is a block diagram which explains principles of the tone correction process performed by the image forming apparatus.

FIG. 8 is a block diagram which explains principles of the tone correction process performed by the image forming apparatus. As described above, the image forming apparatus commits the image signal applied from the external apparatus to the main controller 11 which performs predetermined signal processes (including the tone correction process) on the image signal. The processed signal is applied, as an exposure control signal, to the exposure unit 6 via the engine controller 10. Based on the signal thus applied, the exposure unit 6 forms the electrostatic latent image on the photosensitive member 22 in correspondence to the signal. The electrostatic latent image is visualized as the toner image by means of the development unit 4. The resultant toner image is transferred to the intermediate transfer belt 71 and then, transferred and fixed to the sheet S.

The density sensor 60 detects the density (exactly, the toner quantity) of the patch image carried on the intermediate transfer belt 71. According to the conventional tone correction technique for use in the image forming apparatus, the quantity of toner on the intermediate transfer belt 71, as detected by the density sensor, is fed back to the main controller. In other words, the conventional tone correction technique is designed to correct the engine gamma for so far as the intermediate transfer belt. Such a technique does not consider the transferring/fixing characteristics of the image from the intermediate transfer belt to the sheet and hence, is incapable of providing correction for the difference between the quantity of toner on the intermediate transfer belt and the image density on the sheet. Consequently, the technique cannot always ensure the highest image quality on the sheet.

In contrast, the embodiment is arranged such that the quantity of toner on the intermediate transfer belt 71, as detected by the density sensor 60, is converted to the OD value on the sheet S and the resultant OD value is fed back to the main controller 11. The fed-back value is substantially equivalent to the image density which is detected on the sheet S and fed back to the main controller. Such an arrangement permits the main controller 11 to perform the tone correction process wherein both the gamma characteristic of the engine EG and the characteristics of transferring and fixing the image from the intermediate transfer belt 71 to the sheet S are corrected comprehensively. As a result, the embodiment ensures the highest image quality on the sheet S.

Specifically, OD-value conversion tables 124A, 124B containing tabulated transferring/fixing characteristics are provided in the engine controller 10, as shown in FIG. 3. The gamma characteristic detector 123 refers the toner quantity of the patch image (assessment value), as determined from the output from the density sensor 60, to the table 124A or 124B, thereby determining a corresponding OD value. It is noted that the transferring/fixing characteristics slightly vary depending upon the used screen. In this embodiment, therefore, the two OD-value conversion tables 124A, 124B are provided in correspondence to the two screens A, B, respectively, such that a suitable one of the tables may be selected by means of a switching member 203 operatively associated with the switching members 201,202 and 204. The difference of the transferring/fixing characteristics may be addressed as follows, for example.

Figure 9A:
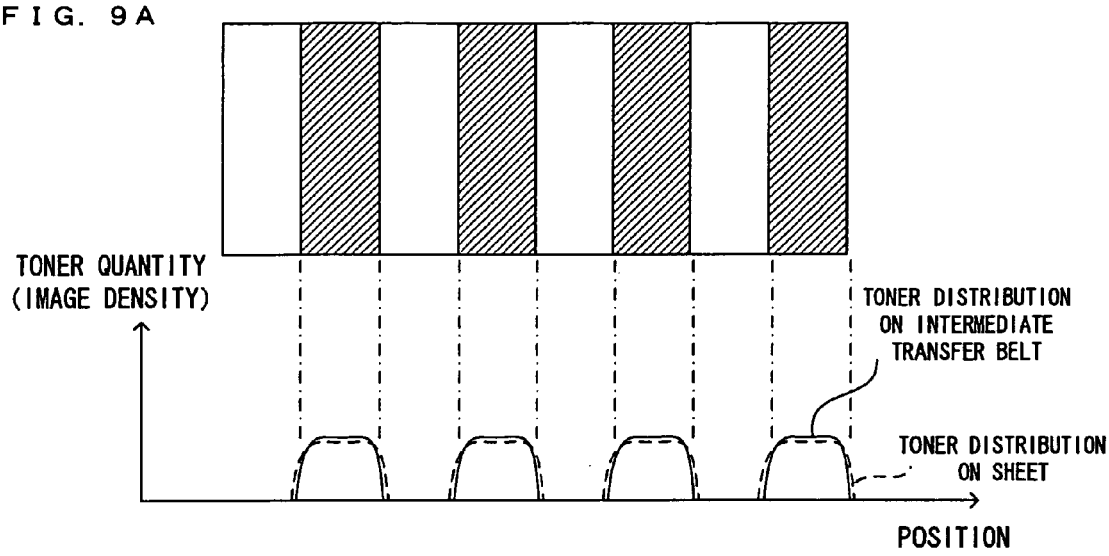
FIG. 9A and FIG. 9B are charts which show relations between a pitch of the screen and an image density.
Figure 9B:
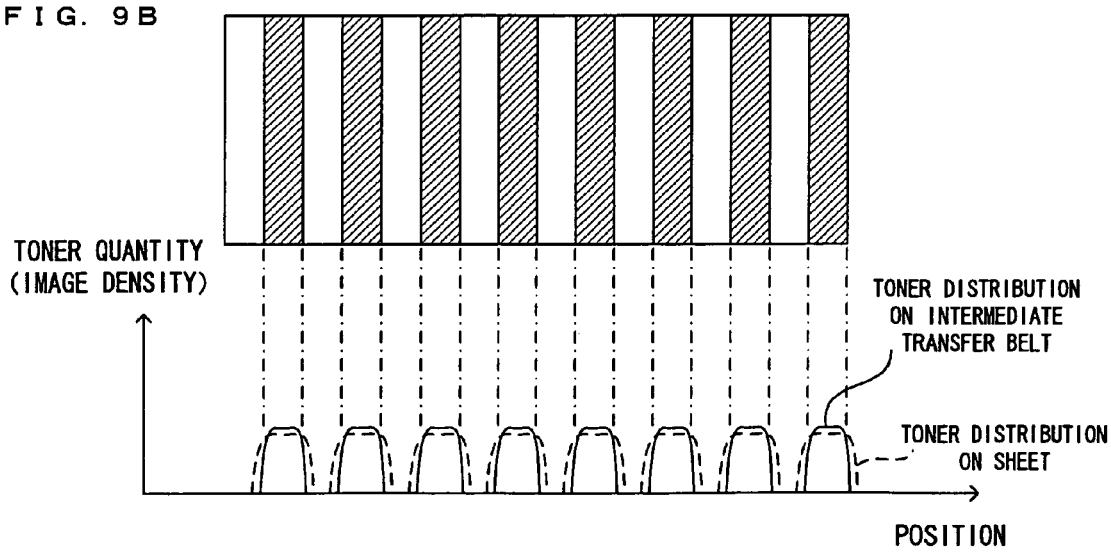

FIG. 9A and FIG. 9B are charts which show relations between a pitch of the screen and an image density. More specifically, FIG. 9A schematically shows an image pattern and a toner quantity of an image formed at a tone level of 50% by using a screen having a greater pitch. FIG. 9B schematically shows the above image formed by using a screen having a smaller pitch. In a case where two images of the same tone level are formed, dots of a relatively greater width are formed in the image formed by using the screen having the greater pitch, and are discretely arranged with spacing corresponding to the screen pitch, as shown in FIG. 9A.

In the case where the screen having the smaller pitch is used, on the other hand, a dot-to-dot pitch is decreased while the width of each dot is decreased, as shown in FIG. 9B. Such an image formed with the smaller pitch is more susceptible to toner scatter when the image is transferred from the intermediate transfer belt 71 to the sheet S as the final recording material. As indicated by a solid line in FIG. 9B, the toner is locally distributed on the intermediate transfer belt 71. When the toner is transferred and fixed to the sheet S, the dot is increased in width as indicated by a broken line in FIG. 9B. In the image formed by using the screen having the greater pitch (FIG. 9A), on the other hand, the toner scatter has a minor influence on the dot width because the dots fundamentally have the great width and are arranged in a smaller number of lines. Because of the different phenomena, the transferring/fixing characteristics may vary depending upon the type of the used screen.

The following phenomenon was actually observed in the experiments conducted by the present inventors. As to the image formed by using the screen having the small pitch, the dot on the sheet S was increased in width from that of the dot on the photosensitive member 22 or on the intermediate transfer belt 71. The density of this image as determined on the sheet S was higher than that of an image having the same tone level and formed by using the screen having the greater pitch. Therefore, the OD-value conversion tables provided in correspondence to the respective types of screens are quite useful in the light of achieving the excellent tone reproduction irrespective of the used screen.

Figure 10:
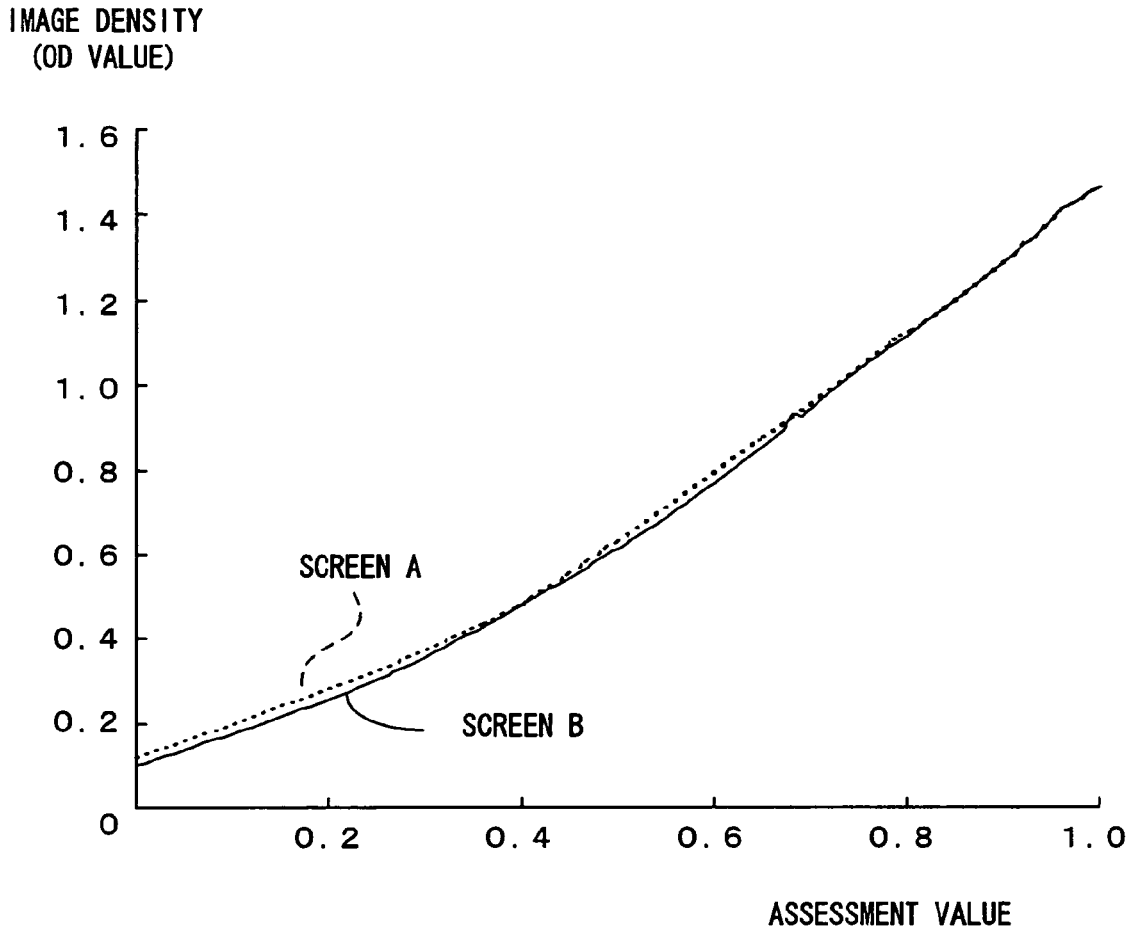
FIG. 10 is a chart which illustrates the OD-value conversion table.

FIG. 10 is a chart which illustrates the OD-value conversion table. The OD-value conversion tables 124A, 124B are actually implemented in tables which contain numerical values represented by characteristic curves shown in FIG. 10, and which are stored in the ROM 106. The OD-value conversion tables are prepared such that the two screens have little difference in the transferring/fixing characteristics in a high-density region, as shown in FIG. 10. In a low-density region, however, the screen A having the smaller pitch permits the same quantity of toner, as detected on the intermediate transfer belt 71, to present the higher on-sheet image density than the screen B.

It is further preferred that a set of plural different tables are previously prepared for each of the OD-value conversion tables 124A, 124B, so that one of the tables may be selectively used based on the operation history of the apparatus. The reason is as follows.

Figure 11:
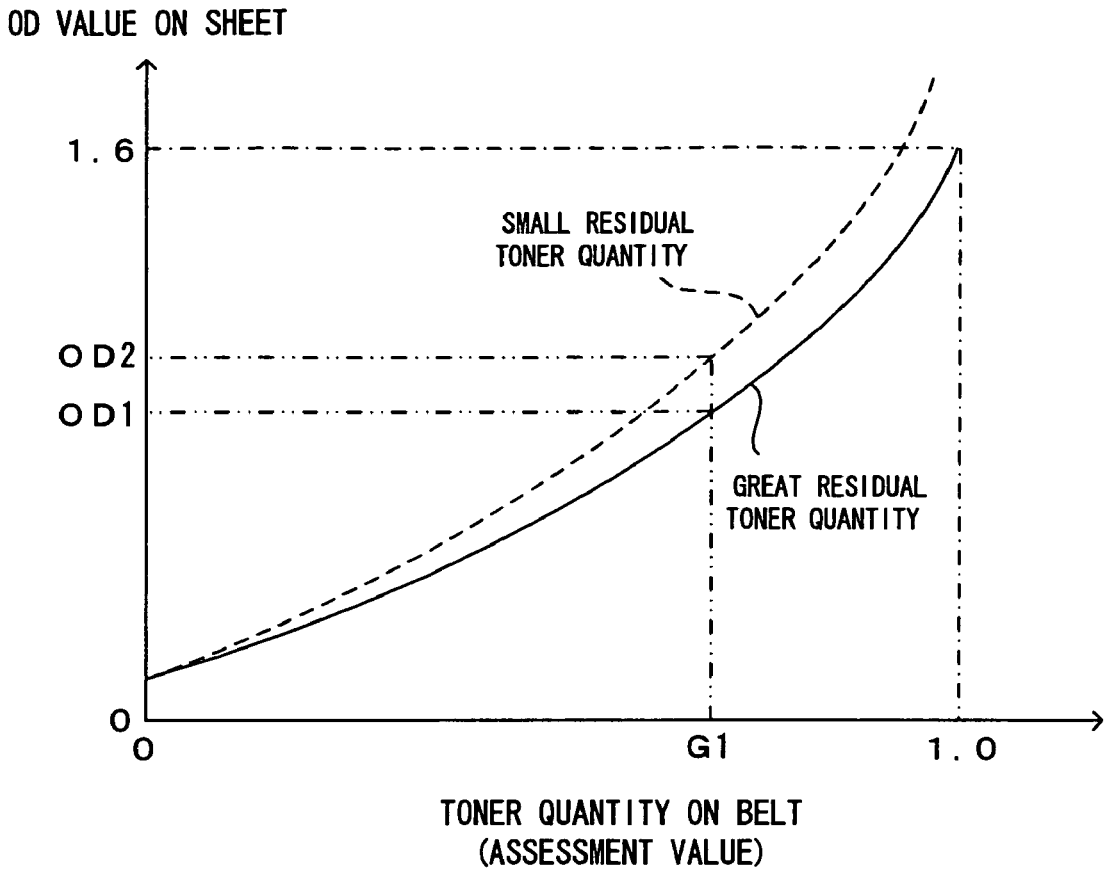
FIG. 11 is a chart which shows an example of the transferring/fixing characteristics.

FIG. 11 is a chart which shows an example of the transferring/fixing characteristics. As shown in FIG. 11, the transferring/fixing characteristics may be represented by a transferring/fixing characteristic curve on a coordinate plane having the toner quantity on intermediate transfer belt (assessment value) on the abscissa and the on-sheet OD value on the ordinate. The transferring/fixing characteristic curve varies according to the operation history of the apparatus. For instance, particle-size distribution and charge characteristic of the toner in the developer differ between a state where the developer stores therein a sufficient quantity of toner (solid line) and a state where the residual toner quantity runs low (broken line). Such differences lead to the variations of the transferring/fixing characteristic curve. Furthermore, a certain degree of deterioration of the photosensitive member 22 or the developing roller 44 may result in the variations of the transferring/fixing characteristic curve.

The following problem may result from that the transferring/fixing characteristic curve varies according to the operation history of the apparatus. Even though a constant quantity of toner is detected from a toner image on the intermediate transfer belt 71, the density of an image as the result of fixing the toner image to the sheet S may vary according to the operation history of the apparatus. According to the example shown in FIG. 11, when an image on the intermediate transfer belt 71 has an assessment value G1, the image transferred to the sheet S has an image density which is potentially varied from OD1 to OD2 depending upon the residual quantity of toner in the developer. Accordingly, if the process for converting the assessment value to the OD value always has the same contents, the apparatus is unable to cope with the variations of the transferring/fixing characteristics. As a result, the image quality on the sheet S becomes instable.

On this account, some options of the OD-value conversion tables are previously prepared on assumption that the transferring/fixing characteristics vary according the operation history of the apparatus. In the conversion from the assessment value to the OD value, one table most suited to the transferring/fixing characteristics estimated from the current operation history of the apparatus may be selected from the options and referred to. Thus, the above problem may be eliminated. Alternatively, only one type of table may be previously prepared. As required, the contents of the table may be corrected and updated according to the operation history of the apparatus.

The aforesaid residual quantity of toner in the developer, cumulative operation time of the photosensitive member 22 or cumulative operation time of the developer 4Y or the like may be used as an index to assess the operation history of the apparatus. With the same residual toner quantity, the characteristics are also varied according to the deterioration of the toner. Hence, cumulative rotation time of the developing roller 44 may also be used as a parameter indicating the degree of deterioration of the toner. Alternatively, some of these parameters may be used in proper combination.

Otherwise, the degree of deterioration of the apparatus may also be determined based on the detected density of a test image formed under specific image forming conditions. At least some of the detected densities of the aforementioned patch image may also be used for this purpose.

According to the embodiment as described above, the detected quantity of toner of the patch image on the intermediate transfer belt 71, as determined from the output signal from the density sensor 60, is converted to the image density (OD value) on the sheet S by using the previously prepared conversion table. Then, the contents of the tone correction process are decided based on the conversion results. Hence, the tone correction is so performed as to correct the gamma characteristics of the overall apparatus, which include the characteristic of the engine EG alone and the transferring/fixing characteristics to the sheet S. As a result, this image forming apparatus may achieve the improved image quality on the sheet S.

By controlling the image density on the sheet S in this manner, the apparatus can attain a high correlation between the image signal applied from the external apparatus and the quantity of toner adhered to the sheet S. Therefore, the toner counter 200 may be increased in the accuracies of the calculation of toner consumption based on the image signal. This permits the apparatus to provide proper management of the service lives of the individual developers.

Furthermore, the tone correction tables 118A, 118B are provided in correspondence to the respective screens to be used. As required, the contents of the correction table are updated based on the detection results of the patch image formed by using the corresponding screen and on the corresponding OD-value conversion table 124A or 124B. Thus, the tone correction may be performed in a favorable manner according to the status of the apparatus or the used screen. Hence, the apparatus is always capable of forming images with favorable tone reproduction. On the other hand, the toner counter 200 is capable of highly accurately calculating the toner consumption whichever of the screens may be used.

In each set of OD-value conversion tables 124A or 124B, the table is changed according to the operation history of the apparatus, thereby permitting the apparatus to cope with the transferring/fixing characteristics varying according to the operation history thereof. Therefore, the apparatus can consistently ensure the good image quality despite the time-related variations thereof.

The embodiment may further offer the following working effect by taking the procedure of converting the output from the density sensor 60 to the on-sheet OD value by means of the engine controller 10 and transmitting the resultant OD value to the main controller 11. The image density (OD value) as defined on the sheet S is primarily determined from the reflectivity of light or the like, and is independent from the constitution of the apparatus which forms the image. Thus, the hardware independent parameter is given thereby permitting the contents of the signal processing by the main controller 11 to be decided irrespective of the hardware constitution of the engine EG. This not only leads to the simplification of the contents of the processes performed by the main controller 11, but also permits the same contents of signal processing to be applied to an apparatus having an engine of a different constitution. As a result, the embodiment may also contribute to the reduction of development and maintenance costs of the apparatus. On the other hand, the detected quantity of toner on the intermediate transfer belt 71 may vary depending upon the used toner or the characteristics of the density sensor. Therefore, the contents of the signal processing based on the detection results must be varied according to the constitution of the apparatus.

According to the embodiment as described above, the main controller 11 and the engine EG respectively function as a "signal processor" and as an "image forming unit" of the invention. The intermediate transfer belt 71 and the density sensor 60 respectively function as an "intermediate transfer medium" and as a "detector" of the invention. The gamma characteristic detector 123 and the OD-value conversion tables 124A, 124B integrally function as "converters" of the invention. The sheet S according to the embodiment is equivalent to the "recording material" of the invention. In this embodiment, the exposure control signal applied from the main controller 11 to the engine EG via the engine controller 10 is equivalent to an "image-formation control signal" of the invention.

Second Embodiment

Next, an image forming apparatus according to a second embodiment of the invention will be described. The apparatus of the embodiment has the same constitution as that of the first embodiment mentioned above. Furthermore, the basic operations of the embodiment are the same as those of the first embodiment. However, the first embodiment discretely performs the tone control process on each processing screen, whereas the second embodiment performs the adjustment of the general operating conditions of the apparatus and the tone control process per processing screen as a sequence of processes.

Figure 12:
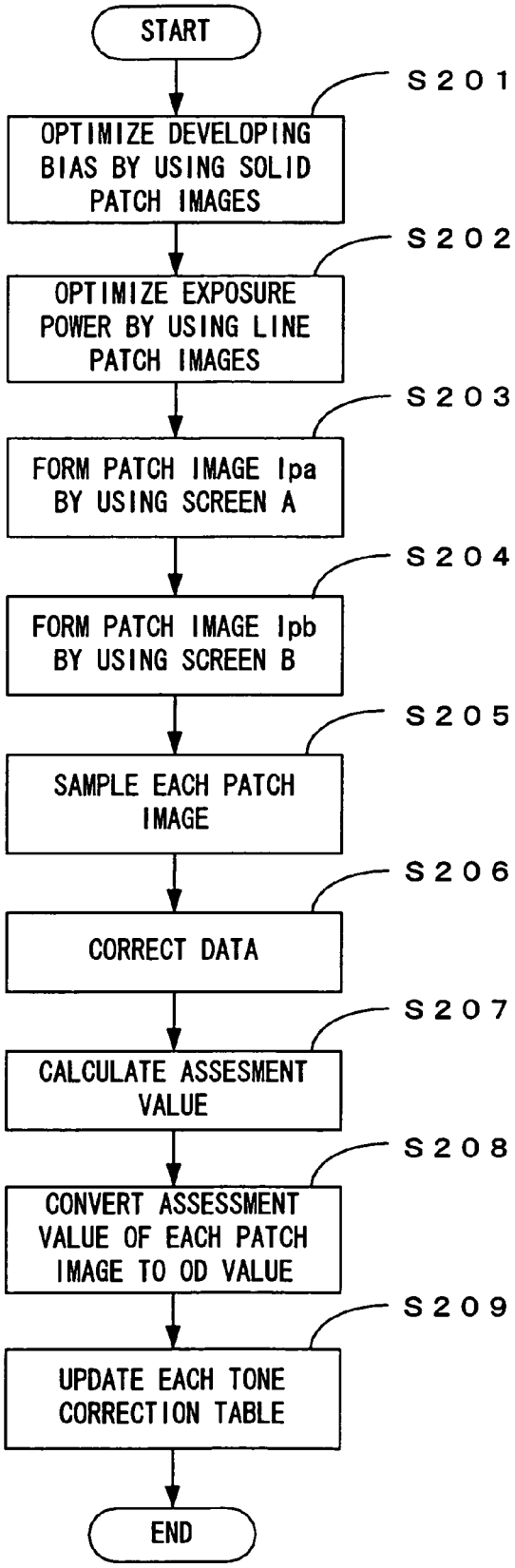
FIG. 12 is a flow chart which shows the steps of a control process according to the second embodiment.

FIG. 12 is a flow chart which shows the steps of a control process according to the second embodiment. The process is performed at a predetermined time such as at power-on of the apparatus, at reversion from a sleep mode or immediately after the replacement of any one of the units. In this process, the developing bias is first optimized (Step S201). More specifically, the developing bias is varied in multiple steps while each of solid images as the patch images is formed at each of the bias values. An optimum value of the developing bias such as to provide a predetermined target density of the solid image is calculated based on the detected densities of the patch image thus formed.

Next, an exposure power is optimized (Step S202). Specifically, with the developing bias fixed to the aforesaid optimum value, the exposure power is varied in multiple steps while each of the patch images is formed at each of the exposure power values. The patch image is, for example, a line image formed in width of one isolated dot and in a pattern of 1 on-dot and 10 off-dots. An optimum value of the exposure power such as to provide a predetermined target density of the line image is calculated based on the detected densities.

The aforementioned solid image and line image have simple and known image patterns and are not subjected to the screening process for halftoning. Hence, it is easy to estimate the densities of such images on the recording material from sampling results given by the density sensor 60 detecting the densities on the intermediate transfer belt 71. In the above process, therefore, the sampling results given by the density sensor 60 need not necessarily be converted to the image densities on the recording material. In other words, such operating conditions as to match the image density with the target density may be practically obtained if a target output value of the density sensor is determined in correspondence to the target image density on the recording material and the optimum values of the developing bias and exposure power are so determined as to achieve the target output value of the density sensor 60.

When the operating conditions of the apparatus are determined in this manner, the subsequent processes are performed under the optimum developing-bias and exposure-power conditions thus determined. Next, the tone control process is performed for determining the tone correction characteristic of each screen (Steps S203 to S209). First, one (screen A) of the two screens is used to form a multigradation patch image Ipa (Step S203). Subsequently, the other screen (screen B) is used to form a multigradation patch image Ipb (Step S204). These patch images are formed as follows.

Figure 13:
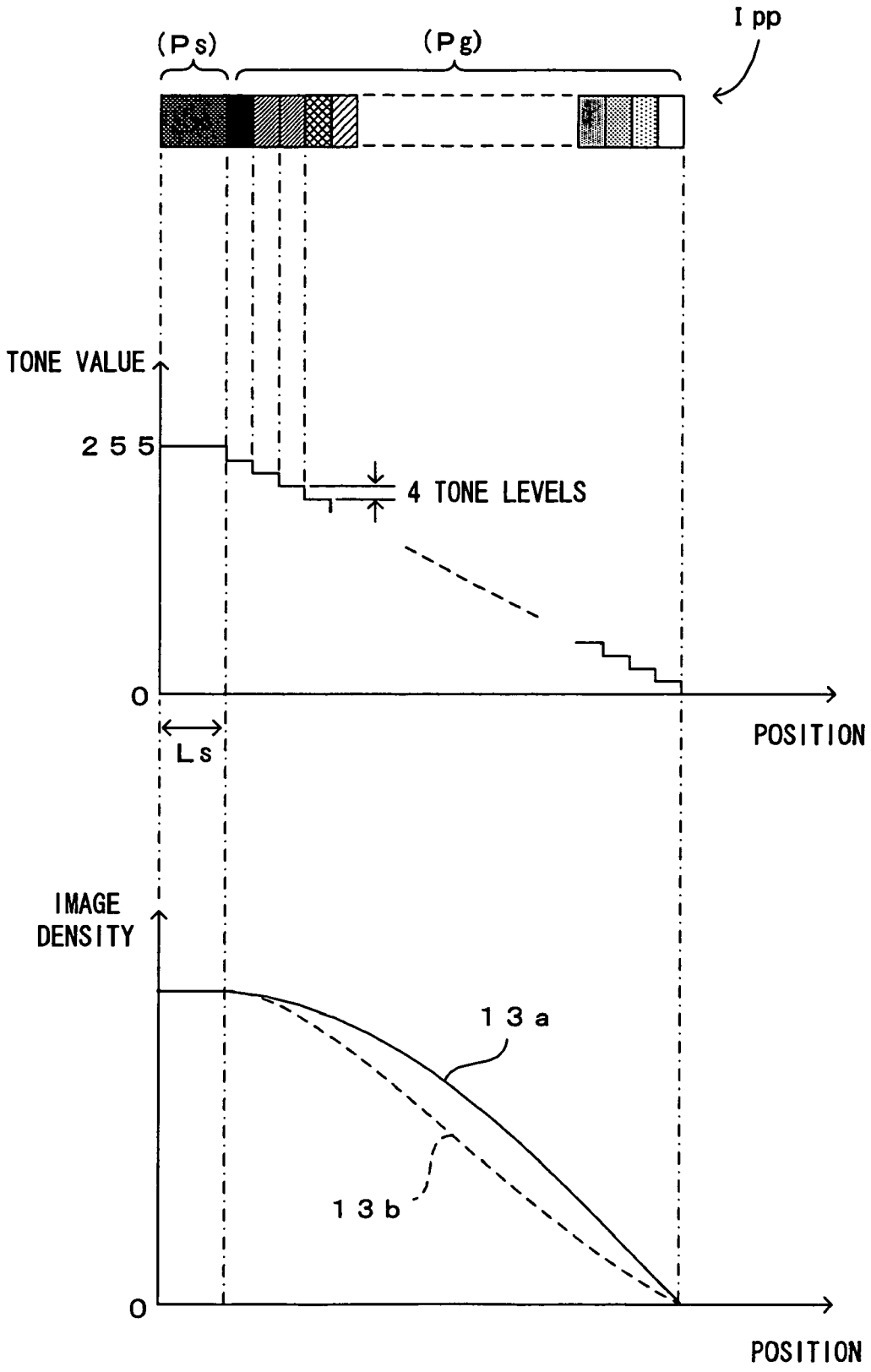
FIG. 13 is a diagram which shows an image pattern of the multigradation patch image according to the second embodiment.
Figure 14:
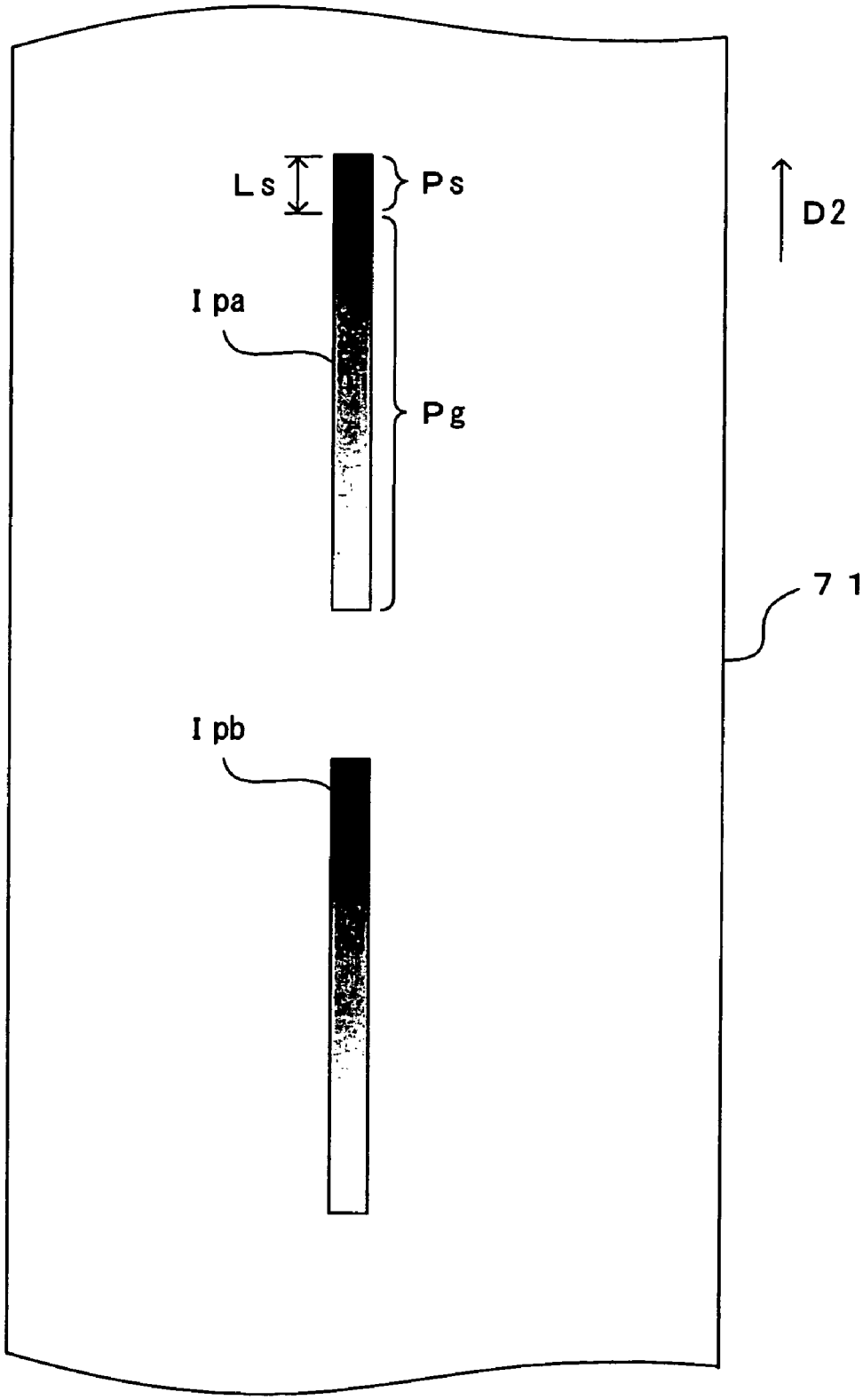
FIG. 14 is a diagram which shows the multigradation patch image on the intermediate transfer belt.

FIG. 13 is a diagram which shows an image pattern of the multigradation patch image according to the second embodiment. FIG. 14 is a diagram which shows the multigradation patch image on the intermediate transfer belt. In the tone control process, the CPU 111 disposed at the main controller 11 generates image data corresponding to an image pattern Ipp shown in FIG. 13. As shown in FIG. 13, the image pattern Ipp includes a pattern corresponding to a solid image portion Ps having the maximum tone value (255), and a pattern corresponding to a gradation image portion Pg which is progressively decreased in the tone value in a predetermined pitch, such as 4 levels. A length Ls of the solid image portion Ps is defined to be about a circumferential length of the developing roller 44 disposed at each of the developers 4Y and the like.

The image data thus generated are subjected to the screening process using each of the two processing screens. The resultant data are sent to the engine EG. The engine EC, in turn, forms the multigradation patch images corresponding to the received data. In this process, the patch images are formed based on the same image pattern Ipp, but the density variations of the formed patch images differ according to the types of the processing screens applied, as illustrated by characteristic curves 13*a*, 13*b* in FIG. 13. This is because the image data are subjected the screening processes having different tone expression characteristics. That is, the density variation curve (density profile) of each multigradation patch image represents the tone expression characteristic of each processing screen.

As the result of forming the patch images in this manner, the multigradation patch images Ipa, Ipb, individually formed using the screen A and the screen B, are arranged on the intermediate transfer belt 71 along the moving direction D2 thereof, as shown in FIG. 14. As the intermediate transfer belt 71 moves, each patch image with its solid image portion Ps positioned to the leading side is moved in the direction D2.

Thus, the multigradation patch images Ipa, Ipb formed on the intermediate transfer belt 71 are each sampled by means of the density sensor 60 (Step S205). The solid image portion Ps of each patch image is the first to be sampled. The sampling results obtained here may be applied to the following uses, for example. The first use is to verify the aforementioned optimization results of the developing bias and exposure power (Steps S201 and S202). As the result of the above processes, the density of the solid image should be controlled to the target image density. Since the final image density is not actually checked, it may be thought that the patch image may possibly fail to achieve the target image density due to detection errors or errors in the computation process. Hence, the sampling result on the solid image portion Ps may be examined thereby to determine whether the developing bias and the exposure power are set correctly or not. In the case of an abnormal result, a proper error handling process may be performed to deactivate the apparatus or to inform the user of the error, for example.

The second use is to use the sampling result as a reference for identifying a sampling position at which the patch image is sampled by the density sensor 60. An object of the tone correction process is to maintain a proper relation between the tone value represented by the image data and the actual image density. In the tone control process, therefore, it is necessary to grasp correctly the correspondence between the sampling results obtained from individual points on the multigradation patch image and the respective tone values assigned the points. If the leading portion of the multigradation patch image is defined by the solid image having the highest density, the output from the density sensor 60 is sharply fluctuated when the patch image reaches the position opposite the density sensor 60. Hence, the sampling may be performed using this point of time of output fluctuation as the reference, whereby the sampling results may be easily and positively correlated to the sampling positions.

The third use is to increase the accuracies of the detection of the density profile. The density of a halftoned image is evaluated relatively to the density of the solid image. Specifically, the correspondence between the tone value and the image density may be more accurately determined by normalizing the sampling result obtained from the gradation image portion Pg based on the sampling result obtained from the solid image portion Ps.

Similarly to the first embodiment, the sampling results obtained from each multigradation patch image are subjected to a predetermined data correction process so as to be converted to assessment values (Steps S206, S207). Subsequently, the assessment values determined for each portion of the multigradation patch image are converted to image densities on the recording material (OD values) (Step S208). In this process, the conversion table 124A corresponding to the used screen A is used for converting the values of the multigradation patch image Ipa. On the other hand, the conversion table 124B corresponding to the used screen B is used for converting the values of the multigradation patch image Ipb. Then, the contents of the tone correction tables 118A, 118B corresponding to the respective screens are updated based on the converted values of the respective images (Step S209).

In the image forming apparatus according to the second embodiment of the invention as described above, the adjustment of the general operating conditions of the apparatus and the decision of the characteristics of the tone correction corresponding to each processing screen are performed as a sequence of processes. The sequence of processes may be performed in a proper timing whereby the image forming apparatus accomplishes the proper tone correction according to the type of the processing screen during the normal image forming operation. Therefore, the apparatus is adapted to form the images of good quality in a consistent manner. In this process, the sampling results obtained from the multigradation patch image by means of the density sensor 60 are converted to the OD values using the conversion table corresponding to the used processing screen and then are processed. Hence, the highest image quality on the recording material may be ensured. In this embodiment, the main controller 11 and the engine controller 10 integrally function as a "controller" of the invention.

According to the process shown in FIG. 12, the operation in Step S202 cannot be started until the optimum value of the developing bias is determined in Step S201. This is because the operation in Step S202 must be performed using the optimum developing bias determined in Step S201. In order to determine the optimum developing bias, the apparatus must wait until the formed solid patch image is transported to place opposite the density sensor 60 and the sampling result is given. This results in an increased process time. The same problem also exists when the operation flow proceeds from the calculation of the optimum exposure power to the tone control process.

However, in a case where the above processes are performed on plural toner colors, the processes may be completed in a shorter time by performing the processes in the following order, for example. When a series of patch images for one toner color are all formed, the developer is immediately switched to the next developer to form the patch images in the next toner color. This approach makes effective use of a time period during which the patch images are transported to place opposite the density sensor 60 to be sampled and the sampled data are computed, thereby permitting the formation of the patch images in another toner color. This results in a notable reduction of the process time as compared with the case where the process of FIG. 12 is sequentially performed on the individual colors.

In the tone control process, the process using each screen is discretely performed so that the apparatus need not wait for the completion of the process using the other screen. Hence, the multigradation patch images Ipa and Ipb corresponding to the respective screens may be successively formed in one toner color. This negates the need to make changeover of developers during the formation of the multigradation patch images Ipa and Ipb.

It is noted that the invention is not limited to the above embodiment and various changes and modifications other than the above may be made thereto so long as such changes and modifications do not deviate from the scope of the invention. In the above embodiment, for example, the assessment value (toner quantity) of the patch image, as determined based on the output from the density sensor 60, is converted to the OD value on the sheet S by using the OD-value conversion table. Alternatively, the conversion to the OD value may also be accomplished by a computation independent from the table, which computation may use, for example, a mathematical expression representing a correlation between the toner quantity and the OD value. Otherwise, the step of converting the assessment value to the OD value may be omitted, while the main controller 11 may directly determine the contents of the tone correction based on the output from the density sensor 60 (or the assessment value) and the transferring/fixing characteristics.

The above embodiment has, for example, the arrangement wherein the density sensor 60 detects the toner quantity of the toner image carried on the intermediate transfer belt 71. However, the apparatus may also have an alternative arrangement wherein the density sensor 60 detects the quantity of toner on the photosensitive member 22. In this case, the photosensitive member 22 is equivalent to the "intermediate transfer medium" of the invention. Accordingly, the term "transferring/fixing characteristics" is defined as characteristics of a process wherein the toner on the photosensitive member 22 is transferred and fixed to the sheet S, as the recording material, via the intermediate transfer belt 71.

The invention may be applied not only to the aforementioned image forming apparatus including the intermediate transfer belt 71, but also to those apparatuses including the other intermediate transfer media such as a transfer drum and a transfer roller, and to an apparatus which is not provided with the intermediate transfer belt and which directly transfers the toner image from the photosensitive member to the recording material. In these cases, as well, similar working effects may be obtained by previously determining the transferring/fixing characteristics of a process wherein the toner quantity on the medium is detected and the toner image is transferred and fixed to the final recording material and by performing the tone correction based on the detected toner quantity and the transferring/fixing characteristics so determined. As a result, the good image quality on the recording material may be achieved.

While FIG. 3 illustrates the arrangement wherein the tone correction section 115 and the halftoning section 116 are separate function blocks, these sections may also be integrated into one function block. In this case, there may be provided a first processing table integrating a processing characteristic of the screen A and the characteristics of the tone correction table 118A corresponding thereto, and a second processing table integrating a processing characteristic of the screen B and the characteristics of the tone correction table 118B corresponding thereto. Either one of the processing tables may be properly selected according to the contents of the image to be formed and used for the signal processing. A mode of the tone control process in this case is defined such that "the previously tabulated processing characteristic of each screen is corrected based on the detected densities of the patch image".

Third Embodiment

According to the foregoing first and second embodiments, the image density on the sheet S is controlled thereby achieving the good image quality and increasing the accuracies of the calculation of the toner consumption. However, the above control may be still unable to completely eliminate a minor calculation error. A third embodiment to be described as below is arranged with an object of coping with such a minor error so as to provide the proper management of the apparatus. An image forming apparatus according to this embodiment has the same arrangement as that of the apparatuses of the first and second embodiments and hence, the description thereof is dispensed with.

Figure 15:
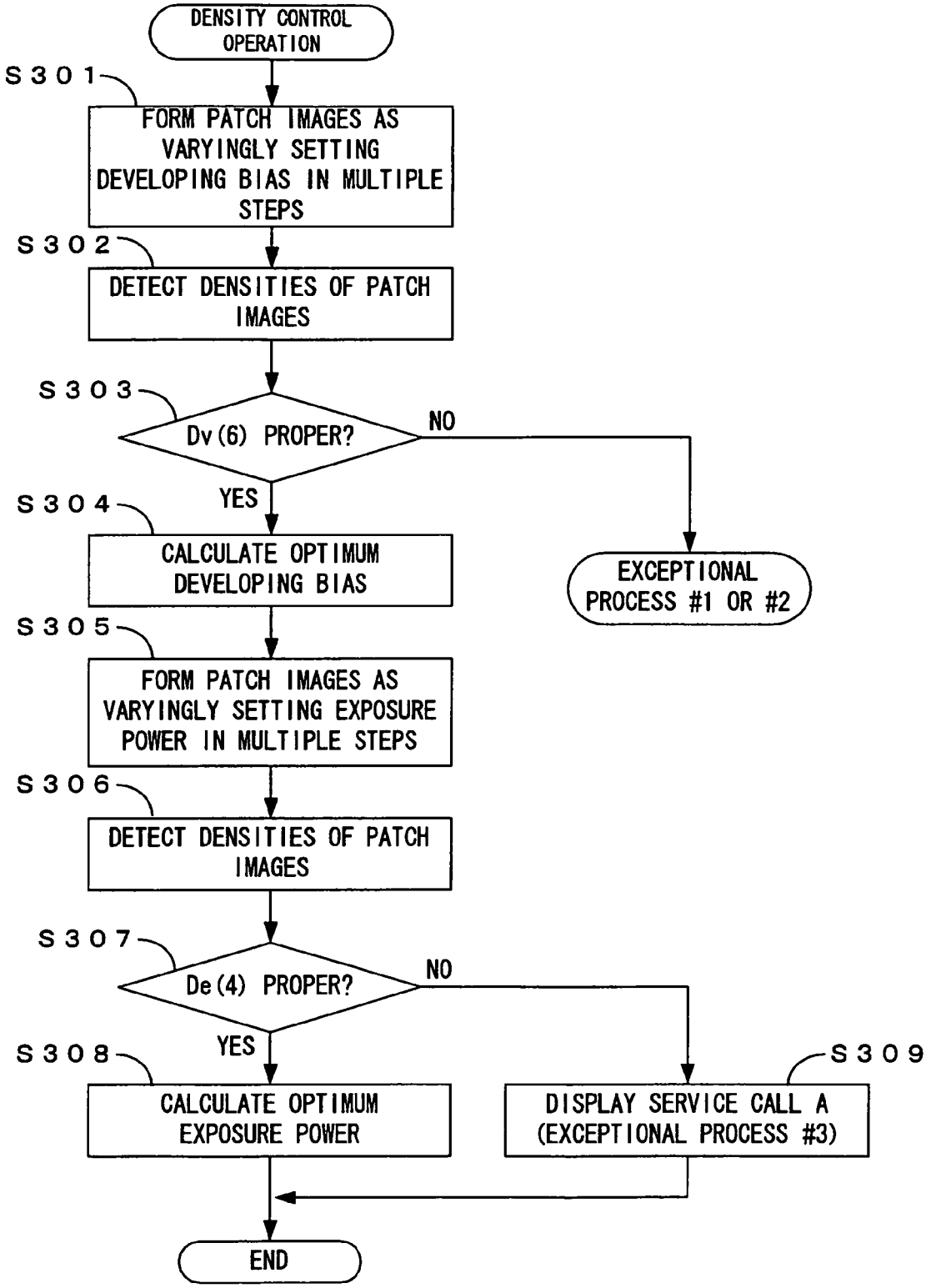
FIG. 15 is a flow chart which shows the steps of a density control operation of the third embodiment.

FIG. 15 is a flow chart which shows the steps of a density control operation of the third embodiment. At a predetermined time such as at power-on of the apparatus or at reversion from a sleep mode, the apparatus of the embodiment performs the density control operation shown in FIG. 15 on a per-toner-color basis. Since there are known a large number of techniques related to such an adjustment operation performed at power-on of the apparatus, a brief description is made here only on the outline of the operation.

First, the developing bias is varied in multiple steps (in six steps as incremented from the smallest bias value V1 to the maximum value V6) while each patch image, such as a solid image, is formed at each of the bias values so set (Step S301). In the solid image, the image density is less affected by the charge potential of the photosensitive member 22 and the intensity of the light beam L from the exposure unit 6. Hence, the adjustment of the developing bias may be accurately and easily accomplished by using the solid images as the patch images. The densities of the resultant patch images are detected by means of the density sensor 60 (Step S302). Out of these patch images, one which is formed at the maximum developing bias is checked here to determine whether the detected density Dv(6) thereof is at a proper value or not (Step S303).

Figure 16:
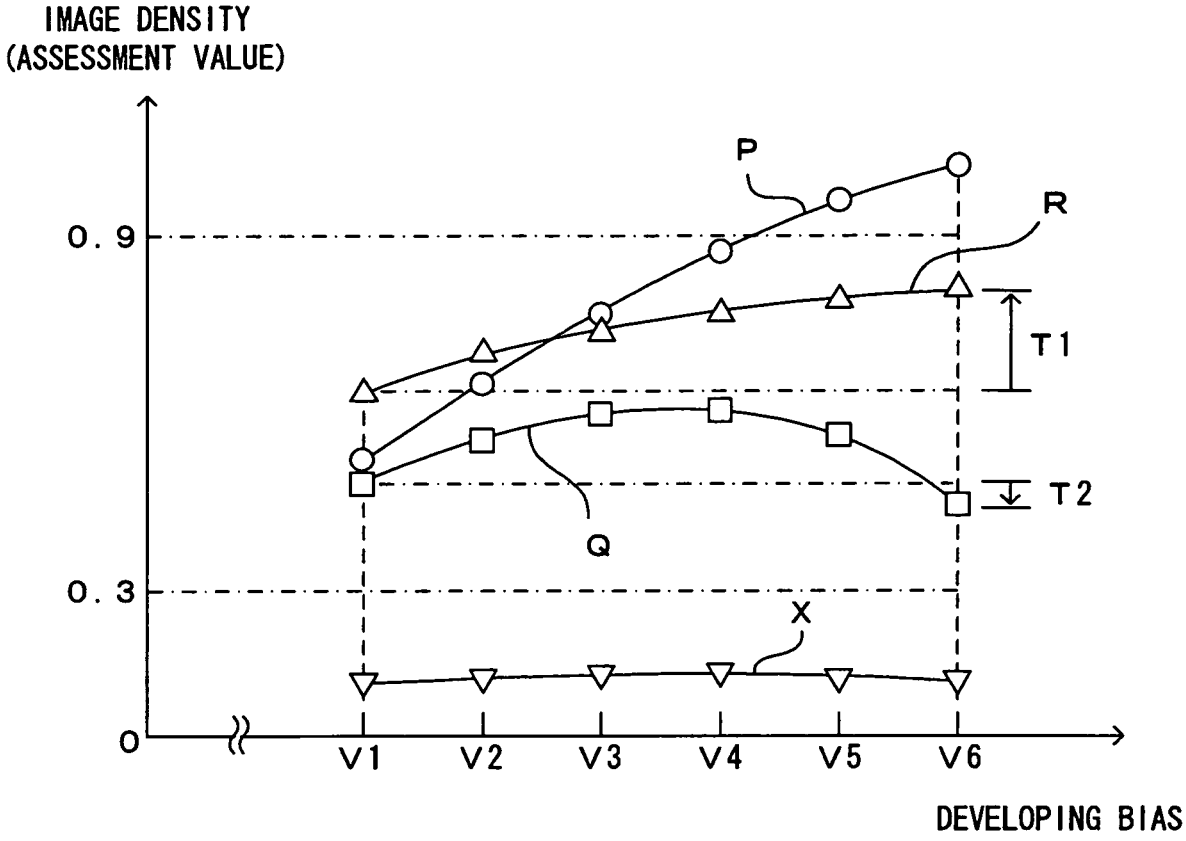
FIG. 16 is a chart which shows a relation between the developing bias and the image density.

FIG. 16 is a chart which shows a relation between the developing bias and the image density. In FIG. 16 and the following description, the image density will be expressed by way of an assessment value described before. The assessment value represents a toner density on the intermediate transfer belt 71 by way of a normalized value ranging from 0 up to 1. Specifically, the assessment value is at 0 when the intermediate transfer belt 71 is absolutely free from toner adhesion. On the other hand, the assessment value is at 1 when the intermediate transfer belt 71 is completely covered with the toner. That is, a toner image formed with the toner in the highest realizable density has the assessment value of 1. More common toner images have assessment values from 0 to 1.

When the apparatus operates normally and a sufficient quantity of toner is stored in the developer, the image density (assessment value) is increased with the increase of the developing bias, as indicated by a curve P in FIG. 16. When the residual toner quantity runs low, however, an increment T1 of the image density decreases despite the increase of the developing bias, as indicated by a curve R. In a more extreme case, the image density is decreased so much despite the increase of the developing bias, that an increment T2 of the image density may take a negative value, as indicated by a curve Q. This is because much of the small quantity of residual toner is consumed for forming preceding patch images so that the toner runs short of forming the succeeding patch images.

As the result of the insufficient residual quantity of toner, the patch images may present density anomaly patterns which include:

(1) the density Dv(6) of the patch image formed at the maximum developing bias V6 is lower than a predetermined density (e.g., 0.9 in terms of the assessment value);

(2) a difference between the density Dv(6) of the patch image formed at the maximum developing bias V6 and the density Dv(1) of the patch image formed at the minimum developing bias V1 is lower than a predetermined value;

(3) the density Dv(6) of the patch image formed at the maximum developing bias V6 is equal to or lower than the density Dv(1) of the patch image formed at the minimum developing bias V1;

and the like. Whether the density Dv(6) of the patch image is proper or not may be determined based on any one of these density anomaly patterns or on judgment criteria consisting of a proper combination of these.

Besides the aforementioned insufficient residual toner quantity, some malfunction of the apparatus may also result in the abnormal density of the patch image. In the case of the malfunction of this kind, as indicated by a curve X in FIG. 16, the image density is usually almost zero regardless of the set values of the developing bias, or usually takes random values irrespective of the developing bias. However, such a malfunction may sometimes conform to the aforementioned judgment criteria. After all, the above judgment criteria fall short of providing an adequate ground, based on which it is concluded that the density deficiency results from the insufficient residual toner quantity. Hence, this embodiment uses the judgment criteria in combination with other judgment criteria for inferring the cause of the density deficiency and takes measures according to the cause so inferred. The details of exceptional processes #1 and #2 performed in the event of density anomaly will be described hereinlater.

Returning to FIG. 15, the density control process will be further described. If it is determined in Step S303 that the detected density Dv(6) of the patch image formed at the developing bias V6 is proper, an optimum developing bias is calculated (Step S304). Based on the detected densities of the patch images formed at the respective bias values, such a developing bias as to provide the target image density or as to provide an image density closest to the target image density is determined to be the optimum developing bias.

Next, the exposure power is adjusted. With the developing bias set to the optimum value, the intensity of the light beam L (exposure power) applied from the exposure unit 6 onto the photosensitive member 22 is varied in multiple steps (four steps in this embodiment) while each halftone image, as the patch image, is formed at each exposure power (Step S305). In the halftone image, the image density is significantly fluctuated by varying the exposure power. Hence, the adjustment of the exposure power may be accurately accomplished by using the halftone images as the patch images.

Then, the respective densities of the patch images are detected by the density sensor 60 (Step S306). In this case, as well, determination is made as to whether the detected density is proper or not (Step S307). Since the density of the patch image formed in the adjustment of the developing bias is proper, it is unreasonable to determine that the density deficiency is caused by the insufficient residual toner quantity or the fundamental malfunction of the apparatus. The most probable cause of the density anomaly in this case is that the quantity of the exposure light is decreased due to a contaminated light-beam output window of the exposure unit 6. Therefore, in a case where a density De(4) of a patch image formed at the maximum exposure power is lower than a predetermined value (e.g., 0.125 in terms of the assessment value), the density deficiency is regarded as a result of the contamination of the exposure unit 6. As an exceptional process #3, a predetermined error message (Service Call A) is displayed on the display unit 12, prompting the user to call for a maintenance service of a service person (Step S309). The service call will be described hereinlater.

In a case where the detected density of the patch image is proper, an optimum exposure power is calculated from these detection results (Step S308). Thus, the optimum values of the developing bias and exposure power for one toner color are determined. The above steps are performed on each of the toner colors.

Next, description is made on the exceptional process performed when it is determined in Step S303 of the density control process of FIG. 15 that the density Dv(6) of the patch image is not proper. In this case, either one of the exceptional processes #1, #2 described as below may be performed.

Figure 17:
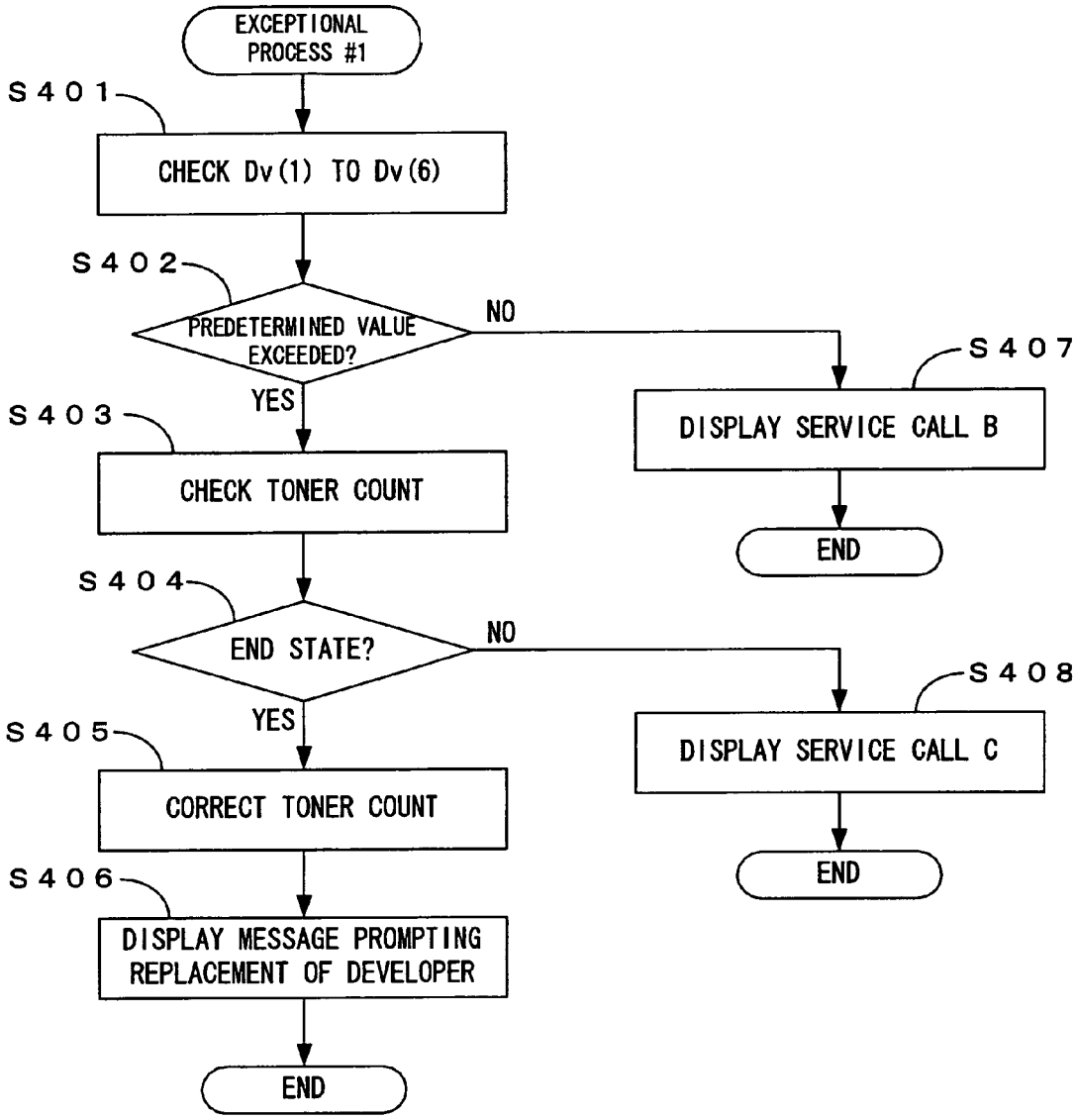
FIG. 17 is a flow chart which shows the steps of the exceptional process #1.

FIG. 17 is a flow chart which shows the steps of the exceptional process #1. In the exceptional process #1, the detection results of all the patch images including the other unchecked images are checked (Step S401). From the standpoint of inferring the cause of the density deficiency, it is only necessary to check at least one of the patch images formed at the other developing biases. In the interests of higher accuracies, however, the embodiment is arranged to check all the patch images.

If the detected densities Dv(1) to Dv(6) of the patch images formed at the developing biases V1 to V6 include at least one exceeding the predetermined value (Step S402), it may be at least inferred that the apparatus is not in a state absolutely incapable of forming images. In this case, the operation flow proceeds to Step S403. On the other hand, if none of the detected densities reach the predetermined value, it is likely, in the first place, that the images are not formed. Hence, a predetermined error message (Service Call B) is displayed on the display unit 12 (Step S407) informing the user of the occurrence of malfunction and then, the density control operation is terminated. It is preferred here to define the predetermined value to be a value corresponding to such a low image density as to be practically ineffective as that of the solid image and as not to be achieved by the apparatus in failed state. An assessment value of 0.3 is used here as the above predetermined value.

If the patch images include at least one whose density is above the assessment value of 0.3, a count value of the toner counter 200 is checked (Step S403). In a case where the count value indicates the following end state, the count value of the toner counter 200 is corrected (Step S405) and a message prompting the user to replace the developer is displayed on the display unit 12 (Step S406). If the developer is not in the end state, an error message (Service Call C) is displayed on the display unit 12 (Step S408).

Figure 18:
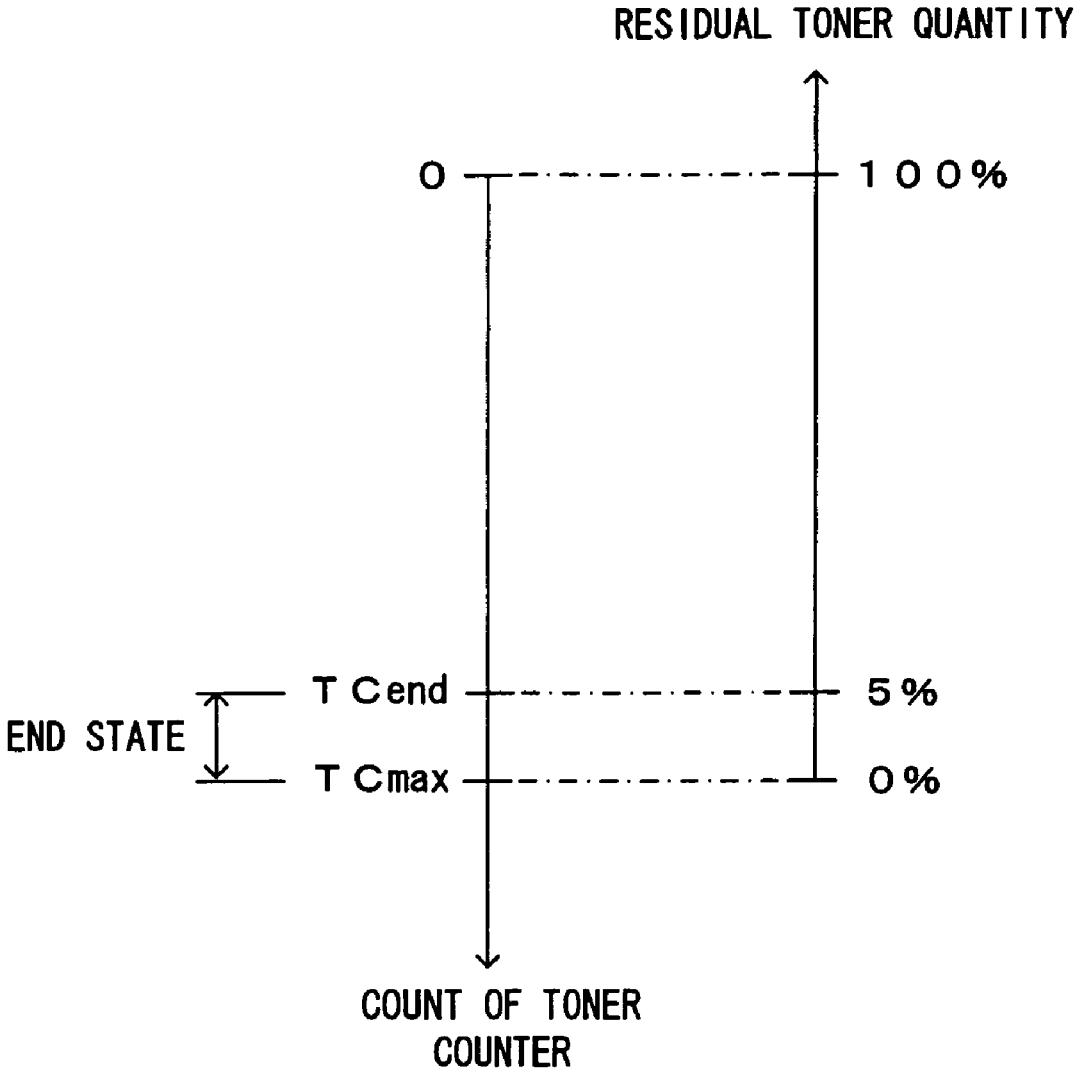
FIG. 18 is a chart which explains the end sate of the developer.

FIG. 18 is a chart which explains the end sate of the developer. The residual toner quantity of the developer may be determined by subtracting a count value of the toner counter 200 from an initial charge quantity. When the developer is fresh, the count value of the toner counter 200 is at 0. As a matter of course, the residual toner quantity is at 100%. As the developer is used longer, the count value of the toner counter 200 increases, whereas the residual toner quantity decreases. When the count value of the toner counter 200 indicates TCend, the residual quantity of the toner in the developer is decreased to 5% of the initial quantity. When the count value reaches TCmax, the residual toner quantity is at 0. The residual toner quantity of 0, as mentioned herein, does not indicate a state where the toner in the developer is completely consumed but indicates a state where any further use of the toner is not allowed. In other words, if the apparatus keeps using such a developer, the apparatus cannot achieve an adequate density of image for practical use.

In a state where the residual toner quantity is decreased to less than 5%, the possibility of formed image sustaining defects, such as deficient density and thin spots, increases progressively. In the light of maintaining the good image quality, therefore, it is preferred to replace the developer when the residual toner quantity is decreased to 5%. However, in order to meet a demand of a user desiring to use the toner more economically, the apparatus is adapted to perform the image forming operation even when the residual toner quantity is in the range of 0% to 5%. The state where the toner counter 200 indicates the value in the range of 0 as the initial value to a value equivalent to 5% in terms of the residual toner quantity, or in the range of TCend to ECmax is referred to as the "end state".

Even when the developer in the end state is used, the apparatus should be able to form images having a certain degree of density. None the less, if the apparatus fails to achieve a required image density, the density deficiency may possibly result from the errors of the toner counter 200. That is, it is possible that the residual toner quantity is actually at 0% although the toner counter 200, having some errors, indicates a value less than TCmax. In the case where the count value of the toner counter 200 indicates the end state, therefore, the count value of the toner counter 200 is forcibly corrected to TCmax (Step S405). Thus, the residual quantity of the toner in the developer is subsequently regarded as 0%.

On the other hand, in a case where the count value of the toner counter 200 does not indicate the end state or is below TCend, it is less likely that the residual toner quantity is decreased so much as to cause a significant decrease of the image density even if the count value may contain some error.

In the case of the density deficiency encountered in this state, therefore, it is highly likely that any other part of the apparatus suffers failure. In this case, therefore, Service Call C prompting inspection by the user or the service person is displayed instead of correcting the count value (Step S408).

According to this embodiment, only when the densities of the toner images formed as the patch images are lower than the predetermined density and when the count value of the toner counter 200 indicates the end state while the other parts of the apparatus do not have symptoms suggesting any failure, the density deficiency is determined to be the result of the insufficient residual toner quantity and the count value of the toner counter 200 is corrected. On the other hand, if it is possible for the other parts of the apparatus to suffer any failure, the count value is not corrected even though the value indicates the end state. According to this approach, a developer storing little toner and unable to form a normal image is considered to have a residual toner quantity of zero, whereas a still serviceable developer is not considered to have the residual toner quantity of zero. Thus is provided the proper management of the service lives of the developers. Furthermore, the malfunction occurred at any other part than the developer may be handled by performing the error handling process corresponding thereto. Thus, the embodiment is also adapted to properly deal with the operation error of the apparatus.

Figure 19:
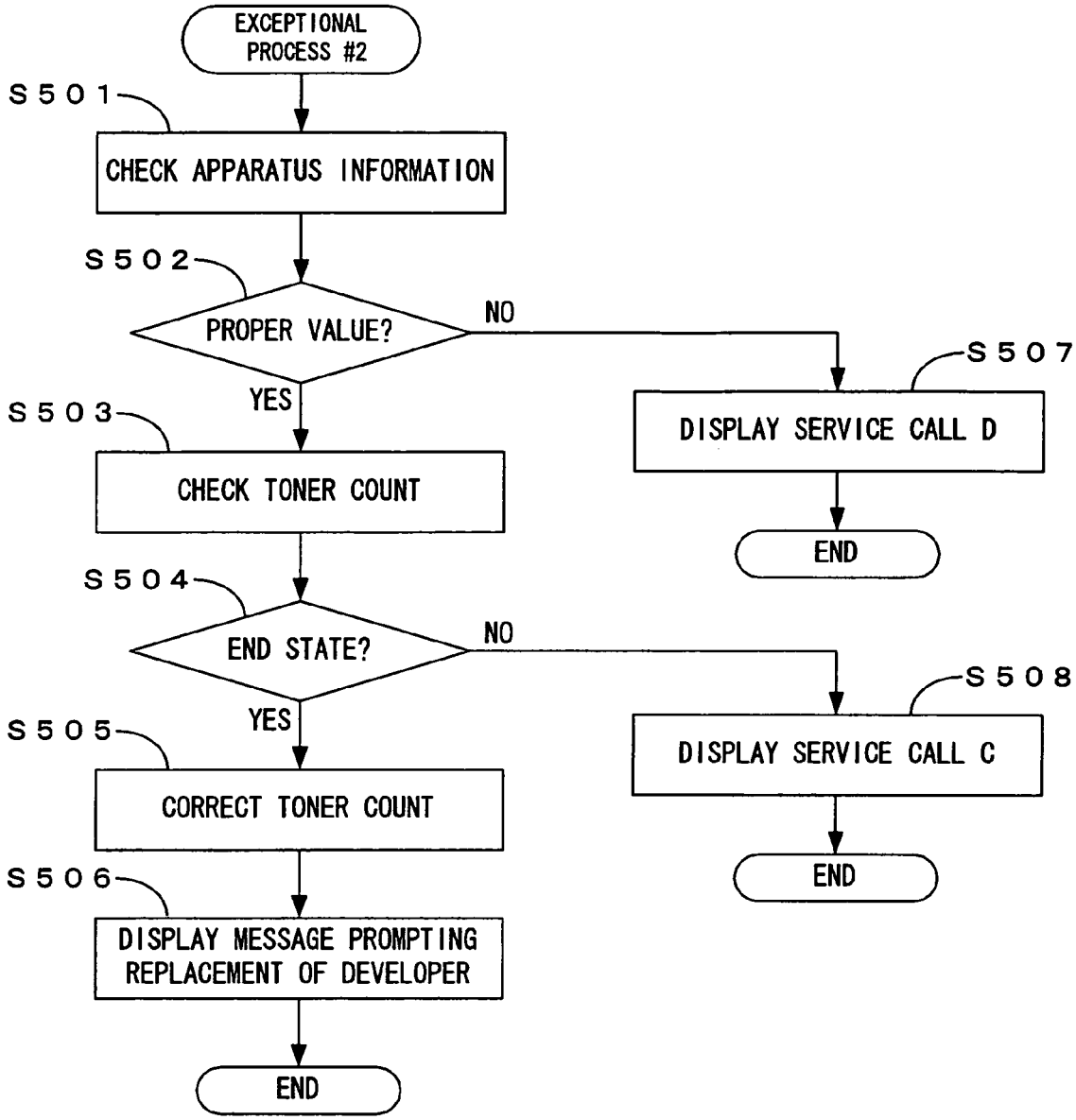
FIG. 19 is a flow chart which shows the steps of the exceptional process #2.

FIG. 19 is a flow chart which shows the steps of the exceptional process #2. The exceptional process #2 is constituted to detect the malfunction of the apparatus in a more direct manner. Specifically, if the density Dv(6) of the patch image formed at the developing bias V6 is not proper, information on the individual parts of the apparatus is acquired (Step S501). Determination is made as to the information value is proper or not and then, the cause of the density deficiency is inferred according to the determination result (Step S502). The subsequent steps (Steps S503 through S508) are basically the same as those of the exceptional process #1. However, because of the different condition from which the cause of the malfunction is inferred, a different error message (Service Call D) from that of the exceptional process #1 is displayed in Step S507.

Figure 20:
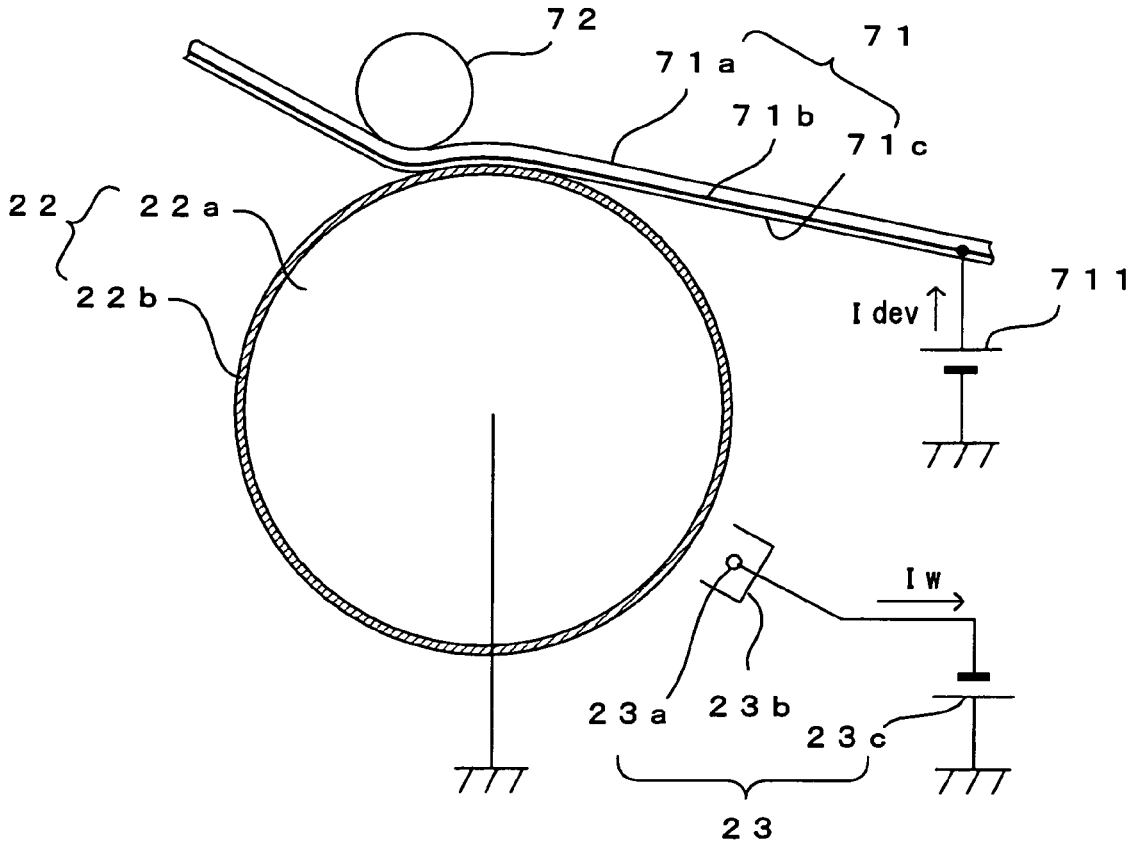
FIG. 20 is a diagram which explains an abnormal operation occurring in the peripheries of the photosensitive member.

FIG. 20 is a diagram which explains an abnormal operation occurring in the peripheries of the photosensitive member. The photosensitive member 22 has a structure wherein a photosensitive layer 22*b* is formed on a surface of a metallic roller 22*a* having a cylindrical shape and electrically grounded. The charger unit 23 charges the photosensitive layer 22*b* to a predetermined potential. The charger unit 23 includes: a charging wire 23*a* disposed in close adjacency to the photosensitive member 22; a shield electrode 23*b* surrounding the wire; and a power source 23*c*. When the power source 23*c* applies a charging bias to the charging wire 23*a*, corona discharge occurs in space between the charging wire 23*a* and the photosensitive layer 22*b*, thus charging the photosensitive layer 22*b*. At this time, the magnitude of current Iw through the charging wire 23*b* is controlled by the power source 23*c*. The current Iw, as used herein, is referred to as a "charging current".

The charging current Iw is principally at a constant value, so that the surface of the photosensitive member 22 is charged at a consistent potential. However, the charging current Iw may sometimes be fluctuated due to the disconnection, deterioration or contamination of the charging wire 23*a*, current leakage to the shield electrode 23*b*, unexpected discharge toward the photosensitive member 22 or the like. Such current fluctuations may cause the photosensitive member 22 to suffer charging failure or fluctuations of the surface potential thereof, finally leading to the variations of the image density.

There may also be a case where the density anomaly occurs in the process of transferring the toner image from the photosensitive member 22 the intermediate transfer belt 71. The intermediate transfer belt 71 is an endless belt comprising laminations of a substrate 71*a* formed from an insulative resin material; a conductive intermediate layer 71*b* formed from a conductive resin material or a metal foil; and a surface layer 71*c* formed from an intermediate resistant material having a higher resistivity than that of the intermediate layer and directly carrying the toner image thereon. A predetermined primary transferring bias from a power source 711 is applied to the conductive intermediate layer 71*b* for promoting the transfer of the toner image from the photosensitive member 22 to the surface layer 71*c*. If the apparatus is in normal operation, a minimum transfer current Idev (of the μA order, for example) flows from the power source 711 to the intermediate layer 71*b*. In some case, however, electric discharge occurs between the photosensitive member 22 and the intermediate transfer belt 71. This involves a large current flow. Furthermore, such an electric discharge disables a correct transfer of the toner image onto the intermediate transfer belt 71, so that the detected density of the patch image on the intermediate transfer belt 71 may be abnormal.

Accordingly, it is also possible to identify the malfunction of the apparatus by detecting the charging current Iw and the transfer current Idev. In the exceptional process #2 (FIG. 19), therefore, either one or both of these currents is detected as the apparatus information. By checking whether the detected information indicates a proper value or not, it is determined whether the deficient density of the patch image is attributed to the insufficient residual quantity of the toner in the developer or to any other cause. In this embodiment, the transfer current Idev is detected and used for determining the cause of malfunction. Thus, the exceptional process #2 is adapted to determine the cause of the malfunction of the apparatus in a more direct manner. However, an additional arrangement for the current detection must be provided.

According to the exceptional process #2 as described above, the count value of the toner counter 200 is corrected when the density of the toner image formed as the patch image is below the predetermined density, and when the count value of the toner counter 200 indicates the end state whereas the transfer current Idev is normal. On the other hand, the count value is not corrected when the transfer current Idev is at abnormal value or when the toner counter 200 does not indicate the end state. In this approach, just as in the exceptional process #1, a developer storing little toner and unable to form a normal image is considered to have the residual toner quantity of zero, whereas a still serviceable developer is not considered to have the residual toner quantity of zero. Thus is provided the proper management of the service lives of the developers.

FIG. 21 is a table which shows the types of the service calls. This embodiment provides the error handling process wherein when it is determined that the apparatus has malfunction, any one of the four service calls is displayed according to the nature of the expected malfunction. The service call A is displayed when a normal adjustment of the exposure power cannot be accomplished. A likely cause of this case is the contamination of the output window of the exposure unit 6. Accordingly, the service call A is accompanied by a message indicating that interest. In a case where the apparatus is so arranged to permit the user to clean the output window, the display unit 12 may indicate a message prompting the user to clean the output window, instead of the service call A.

The service call B is to deal with a case where all the patch images have very low densities. A malfunction expected from such a symptom is a failure of a high-voltage source for generating, for example, the charging bias or the developing bias. Accordingly, the service call B is accompanied by a message indicating that interest. The service call D is issued at detection of an excessive transfer current Idev. An example of the malfunction corresponding to this call is a failure of the transfer unit 7.

The service call C is to deal with the other malfunctions than those whose causes can be inferred as described above. These malfunctions, whose causes are yet to be identified, are simply regarded as "failure in the image forming operation". These service calls need not necessarily have such contents as to let even the general users know the causes, as described above, but may use brevity codes or error codes understandable only to assigned service persons or operators.

On the other hand, the density deficiency associated with the decrease of the residual toner quantity does not fall under the malfunction of the apparatus. Such a density deficiency may be eliminated by replacing the used developer to a fresh one. Hence, a post-process in this case may be accomplished by directing the display unit 12 to display a message prompting the user to replace the developer.

According to the embodiment as described above, in the case where the density of the toner image formed as the patch image is below the predetermined density, index information indicative of the operation status of the apparatus is acquired. Whether the density deficiency is the result of the insufficient residual quantity of the toner in the developer or the result of another cause is determined based on the acquired information. If it is determined that the insufficient residual toner quantity is the cause, the count value of the toner counter 200 is corrected whereby the developer is subsequently prevented from being mistakenly determined to be still serviceable.

In the case where it is determined that the density deficiency is the result of the other cause than the insufficient residual toner quantity, the display unit 12 displays the error message corresponding to the likely cause of the error. This allows the user to take a proper action on the operation error of the apparatus. Furthermore, there may be obviated a problem that although the developer operates normally, the count value of the toner counter 200 is corrected so as to disable the subsequent use of the developer. In the case where the service call is displayed, it is desirable to inhibit the operation of the apparatus until the malfunction is eliminated by the service person.

According to the embodiment as described above, each of the developers 4C, 4K, 4M, 4Y functions as a "toner cartridge" of the invention. The toner counter 200 and the engine controller 10 of the embodiment function as a "counter" and the "controller" of the invention, respectively. The engine EG functions as the "image forming unit" of the invention, whereas the exposure unit 6, the photosensitive member 22, the charger unit 23, the density sensor 60 and the intermediate transfer belt 71 function as an "exposure unit", a "photosensitive member", a "charger unit", the "detector" and a "transfer medium" of the invention, respectively. In this embodiment, the patch images formed at the respective developing biases V6 and V1 are equivalent to a "first toner image" and a "third toner image" of the invention, respectively, whereas the individual patch images formed at the other developing biases are equivalent to a "second toner image" hereof.

It is to be noted that the invention is not limited to the foregoing embodiment and various modifications other than the above may be made thereto unless such modifications deviate from the scope of the invention. For instance, the above embodiment uses the patch image formed at the maximum developing bias as the "first toner image" of the invention. However, the first toner image hereof may also be any other image formed at any other bias value or under different conditions than the above. While the embodiment uses the patch image formed for the purpose of the density control operation, the patch image is not limited to this. Any other images formed for the purpose of the invention or any other purposes are also usable. However, if the process is performed based on the detected density of the image principally formed for the other purpose, as suggested by the embodiments, it is unnecessary to form an additional image for practicing the invention. Thus, the waste of toner and process time may be avoided.

The embodiment is constituted to determine the density deficiency based on the detected density of the patch image. An alternative constitution, for example, may also be made such that the user determines the density deficiency by visual inspection and manipulates the apparatus to input the inspection result thereto.

The foregoing embodiment uses the detected densities Dv(1) to Dv(6) of the patch images, the charging current Iw, the transfer current Idev and the like as the "index information" of the invention. However, the index information may further include, for example, bias voltages detected at the individual parts of the apparatus. Furthermore, a signal used for confirming the activation of the light source of the exposure unit 6 may also be used as the index information.

In the exceptional processes #1 and #2 of the foregoing embodiment, the density of the patch image or the information item such as the transfer current is checked before the count value of the toner counter is checked. However, the order of checking steps may be inverted.

In the above embodiment, the malfunctions of the apparatus other than the insufficient residual toner quantity are classified into the four patterns, so that individually different service calls may be issued. What is required from the viewpoint of the objects of the invention is at least to differentiate the insufficient residual quantity of the toner in the developer from the other causes. Hence, only one type of service call may be provided.

In the case where the density deficiency is determined to be the result of the other cause than the insufficient residual toner quantity, the error handling process of the above embodiment is performed simply to display the message indicating that interest. However, the contents of the error handling process are not limited to this. For instance, when it is determined that some other malfunction than the insufficient residual toner quantity is encountered by the apparatus, a predetermined self-diagnosing program may be activated for more specific examination of the error cause. In the case of an easily removable error, a predetermined operation may be automatically performed or performed by the user thereby eliminating the error.

While the foregoing embodiments apply the invention to the apparatus for forming the image by using the four color toners of yellow, magenta, cyan and black, the kinds or the number of toner colors are not limited to the above and are optional. The invention is not only applicable to the apparatus of the rotary development system but also to an image forming apparatus of a so-called tandem system wherein the developers corresponding to the respective toner colors are arranged in a line along the sheet transport direction. Furthermore, the invention is not only applicable to the electrophotographic apparatuses of the foregoing embodiments but also to the all types of image forming apparatuses.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. An image forming apparatus comprising:

a toner cartridge storing a toner;

an image forming unit which forms a toner image with the toner supplied from the toner cartridge;

a counter which counts a consumption of the toner in the toner cartridge; and a controller which makes judgment on necessity of a correction of a count value counted by the counter when a density of a first toner image formed by the image forming unit is lower than a first density previously defined in correspondence to the first toner image based on a quantity of the toner in the toner cartridge indicated by the count value of the counter and index information which indicates a status of the apparatus, and which corrects the count value of the counter when determining the correction of the count value to be necessary, wherein the controller uses a detected density of a second toner image as the index information, the second toner image formed by the image forming unit where an operation parameter affecting the image density is set to a different value from the value used in the formation of the first toner image, and the controller determines the correction of the count value to be necessary if a residual quantity of the toner in the toner cartridge indicated by the count value is smaller than a predetermined quantity and the second toner image has a higher density than a second predetermined density.

2. An image forming apparatus according to claim 1, wherein when determining the correction of the count value to be necessary, the controller corrects the count value to a value equivalent to a total quantity of toner feedable from the toner cartridge.

3. An image forming apparatus according to claim 1, wherein the first density is defined by a density of a third toner image or a summation of the density of the third toner image and a predetermined offset value, the third toner image formed by the image forming unit where an operation parameter affecting the image density is set to a value to provide a lower density than that of the first toner image.

4. An image forming apparatus according to claim 1, wherein the controller performs a density control operation for adjusting an operation parameter affecting the image density of the image forming unit based on a detected density of a toner image formed as a patch image by means of the image forming unit, and wherein the first toner image is defined by at least a part of the patch image.

5. A control method of an image forming apparatus which includes: a toner cartridge storing a toner; an image forming unit which forms a toner image with the toner supplied from the toner cartridge; and a counter which counts a consumption of the toner in the toner cartridge, the control method comprising:

a detection step of detecting a density of a first toner image formed by the image forming unit;

a judgment step of determining a necessity of a correction of a count value of the counter based on index information related to a status of the apparatus when the density of the first toner image is lower than a first density previously defined in correspondence to the first toner image and a quantity of the toner in the toner cartridge determined from the count value of the counter is smaller than a predetermined quantity;

a correction step of correcting the count value of the counter when it is determined in the judgment step that the correction of the count value is necessary;

a step of using a detected density of a second toner image as the index information, the second toner image formed by the image forming unit where an operation parameter affecting the image density is set to a different value from the value used in the formation of the first toner image; and a step of determining the correction of the count value to be necessary if a residual quantity of the toner in the toner cartridge indicated by the count value is smaller than a predetermined quantity and the second toner image has a higher density than a second predetermined density.

6. An image forming apparatus comprising:

a toner cartridge storing a toner;

an image forming unit that forms a toner image with the toner supplied from the toner cartridge;

a counter that counts a consumption of the toner in the toner cartridge; and a controller that makes judgment on necessity of a correction of a count value counted by the counter when a density of a first toner image formed by the image forming unit is lower than a first density previously defined in correspondence to the first toner image based on a quantity of the toner in the toner cartridge indicated by the count value of the counter and index information that indicates a status of the apparatus, and that corrects the count value of the counter when determining the correction of the count value to be necessary, wherein the controller:

uses detected densities of plural toner images as the index information, the plural toner images being formed by the image forming unit with operation parameters affecting the image density being set to different values from each other, and determines the correction of the count value to be necessary if a residual quantity of the toner in the toner cartridge indicated by the count value is smaller than a predetermined quantity and at least one of the plural toner images has a higher density than a predetermined value corresponding to a low image density to be practically ineffective.

7. A control method of an image forming apparatus that includes: a toner cartridge storing a toner; an image forming unit that forms a toner image with the toner supplied from the toner cartridge; and a counter that counts a consumption of the toner in the toner cartridge, the control method comprising:

a detection step of detecting a density of a first toner image formed by the image forming unit;

a judgment step of determining a necessity of a correction of a count value of the counter based on index information related to a status of the apparatus when the density of the first toner image is lower than a first density previously defined in correspondence to the first toner image and a quantity of the toner in the toner cartridge determined from the count value of the counter is smaller than a predetermined quantity;

a correction step of correcting the count value of the counter when it is determined in the judgment step that the correction of the count value is necessary;

a step of using detected densities of plural toner images as the index information, the plural toner images being formed by the image forming unit with operation parameters affecting the image density being set to different values from each other; and a step of determining the correction of the count value to be necessary if a residual quantity of the toner in the toner cartridge indicated by the count value is smaller than a predetermined quantity and at least one of the plural toner images has a higher density than a predetermined value corresponding to a low image density to be practically ineffective.

* * * * *